US008347640B2

(12) United States Patent
DeMonte et al.

(10) Patent No.: US 8,347,640 B2
(45) Date of Patent: Jan. 8, 2013

(54) ENHANCED PERFORMANCE DEHUMIDIFICATION APPARATUS, SYSTEM AND METHOD

(75) Inventors: Todd DeMonte, Cottage Grove, WI (US); Scott E. Sloan, Freeport, IL (US); Steven S. Dingle, McFarland, WI (US); Timothy S. O'Brien, DeForest, WI (US); Phillip R. Steinmetz, Stoughton, WI (US)

(73) Assignee: Technologies Holdings Corp., Houston, TX (US)

( * ) Notice: Subject to any disclaimer, the term of this patent is extended or adjusted under 35 U.S.C. 154(b) by 794 days.

(21) Appl. No.: 12/473,874

(22) Filed: May 28, 2009

(65) Prior Publication Data

US 2010/0212334 A1 Aug. 26, 2010

Related U.S. Application Data

(63) Continuation-in-part of application No. 11/872,106, filed on Oct. 15, 2007, now Pat. No. 7,540,166, which is a continuation of application No. 11/280,056, filed on Nov. 16, 2005, now Pat. No. 7,281,389.

(51) Int. Cl.
*F25D 17/06* (2006.01)

(52) U.S. Cl. ..... 62/93

(58) Field of Classification Search ..... 62/93, 101, 62/157, 176.1, 272, 404, 498
See application file for complete search history.

(56) References Cited

U.S. PATENT DOCUMENTS

| | | | |
|---|---|---|---|
| 2,128,641 | A | 8/1937 | Folsom |
| 2,093,725 | A | 9/1937 | Hull |
| 2,286,605 | A | 6/1942 | Crawford |
| 2,438,120 | A | 3/1948 | Freygang |
| 2,682,758 | A | 7/1954 | Harris |
| 2,763,132 | A | 9/1956 | Jue |
| 2,968,167 | A | 1/1961 | Raney |
| 2,975,609 | A | 3/1961 | Allander et al. |
| 3,496,731 | A | 2/1970 | Sholtes |
| 3,640,090 | A | 2/1972 | Ares |
| 3,738,117 | A | 6/1973 | Engel |
| 3,739,487 | A | 6/1973 | Clark |
| 3,741,290 | A | 6/1973 | Nenadal |

(Continued)

FOREIGN PATENT DOCUMENTS

| | | | |
|---|---|---|---|
| CA | 1 301 739 | C | 5/1992 |

(Continued)

OTHER PUBLICATIONS

Material for Aquatrap AT1005 LGR Dehumidifier cited in the reexamination proceeding for U.S. Patent No. 7,540,166, Abatement Technologies, Inc., Copyright 2007, 4 pages.

(Continued)

*Primary Examiner* — Melvin Jones
(74) *Attorney, Agent, or Firm* — Andrus, Sceales, Starke & Sawall, LLP

(57) ABSTRACT

A dehumidifier includes an air flow path with first, second and third segments in series from upstream to downstream and passing ambient air respectively to an evaporator coil then to a condenser coil and then discharging same. The air flow path has a fourth segment passing ambient air to the condenser coil in parallel with the noted second air flow path segment. A bypass door is configured to selectively block air flow along the fourth segment and allow air flow along the fourth segment.

24 Claims, 19 Drawing Sheets

U.S. PATENT DOCUMENTS

| | | | | |
|---|---|---|---|---|
| 3,867,979 | A | 2/1975 | Carrasse et al. | |
| 3,899,023 | A | 8/1975 | Zander et al. | |
| 3,938,348 | A | 2/1976 | Rickert | |
| 4,176,525 | A | 12/1979 | Tucker et al. | |
| 4,178,767 | A | 12/1979 | Shaw | |
| 4,193,443 | A | 3/1980 | Nanaumi et al. | |
| 4,214,454 | A | 7/1980 | Taylor | |
| 4,250,629 | A | 2/1981 | Lewis | |
| 4,428,205 | A | 1/1984 | Doderer | |
| 4,428,207 | A | 1/1984 | Hall | |
| 4,432,147 | A | 2/1984 | Chen et al. | |
| 4,531,890 | A | 7/1985 | Stokes | |
| 4,607,498 | A | 8/1986 | Dinh | |
| 4,635,446 | A | 1/1987 | Meckler | |
| 4,712,382 | A | 12/1987 | Le Clear | |
| 4,738,120 | A | 4/1988 | Lin | |
| 4,883,329 | A | 11/1989 | Flannery et al. | |
| 4,917,174 | A | 4/1990 | Ring | |
| 4,928,498 | A | 5/1990 | Gossler | |
| 5,031,411 | A * | 7/1991 | Gehring et al. | 62/93 |
| 5,069,691 | A | 12/1991 | Travis et al. | |
| 5,070,703 | A | 12/1991 | Wilkinson | |
| 5,117,651 | A | 6/1992 | Suh | |
| 5,119,571 | A | 6/1992 | Beasley | |
| 5,230,723 | A | 7/1993 | Travis et al. | |
| 5,275,233 | A | 1/1994 | Little | |
| 5,299,431 | A | 4/1994 | Iritani et al. | |
| 5,309,725 | A | 5/1994 | Cayce | |
| 5,327,740 | A | 7/1994 | Ogasawara et al. | |
| 5,346,127 | A | 9/1994 | Creighton | |
| 5,400,607 | A | 3/1995 | Cayce | |
| 5,431,890 | A | 7/1995 | Crossland et al. | |
| 5,433,763 | A | 7/1995 | Shagott et al. | |
| 5,443,624 | A | 8/1995 | Claesson | |
| 5,553,462 | A | 9/1996 | Taylor | |
| 5,588,985 | A | 12/1996 | Shagott et al. | |
| 5,593,470 | A | 1/1997 | Shagott et al. | |
| 5,611,209 | A | 3/1997 | Ogasawara | |
| 5,634,353 | A | 6/1997 | Hallin et al. | |
| 5,651,258 | A | 7/1997 | Harris | |
| 5,666,813 | A | 9/1997 | Brune | |
| 5,689,962 | A | 11/1997 | Rafalovich | |
| 5,709,736 | A | 1/1998 | Fujimara | |
| 5,727,623 | A | 3/1998 | Yoshioka et al. | |
| 5,752,389 | A | 5/1998 | Harper | |
| 5,794,453 | A | 8/1998 | Barnwell | |
| 5,813,089 | A | 9/1998 | Nolan et al. | |
| 5,890,368 | A | 4/1999 | Lakdawala | |
| 5,901,565 | A | 5/1999 | Morton, Jr. | |
| 5,953,926 | A | 9/1999 | Dressler et al. | |
| 5,975,191 | A | 11/1999 | Ohashi et al. | |
| 6,021,644 | A | 2/2000 | Ares et al. | |
| 6,131,653 | A | 10/2000 | Larsson | |
| 6,170,271 | B1 | 1/2001 | Sullivan | |
| 6,321,558 | B1 | 11/2001 | Pruse | |
| 6,427,454 | B1 | 8/2002 | West | |
| 6,498,876 | B1 | 12/2002 | Liu et al. | |
| 6,751,964 | B2 | 6/2004 | Fischer | |
| 6,796,896 | B2 | 9/2004 | Laiti | |
| 6,826,921 | B1 | 12/2004 | Uselton | |
| 6,895,774 | B1 | 5/2005 | Ares et al. | |
| 7,191,604 | B1 | 3/2007 | Wiggs | |
| 7,194,870 | B1 | 3/2007 | O'Brien et al. | |
| 7,246,503 | B1 | 7/2007 | O'Brien et al. | |
| 7,281,389 | B1 * | 10/2007 | O'Brien et al. | 62/272 |
| 7,331,759 | B1 | 2/2008 | Tejeda | |
| D572,356 | S | 7/2008 | Harber | |
| 7,504,166 | B2 * | 3/2009 | Chen et al. | 428/827 |
| 7,540,166 | B2 | 6/2009 | O'Brien et al. | |
| 2003/0126876 | A1 | 7/2003 | Maisotsenko et al. | |
| 2005/0091993 | A1 | 5/2005 | Paradis | |
| 2007/0012060 | A1 | 1/2007 | Simons | |
| 2007/0193287 | A1 | 8/2007 | Ishida et al. | |
| 2009/0205354 | A1 | 8/2009 | Brown | |

FOREIGN PATENT DOCUMENTS

| | | | |
|---|---|---|---|
| CA | 2 654 674 | A1 | 8/2009 |
| DE | 21 49 548 | A1 | 4/1972 |
| DE | 24 13 618 | A1 | 9/1975 |
| DE | 87 07 953 | U1 | 7/1988 |
| DE | 197 31 369 | C1 | 7/1998 |
| EP | 0 231 789 | A2 | 8/1987 |
| EP | 1028891 | B1 | 1/2004 |
| GB | 1400255 | | 7/1975 |
| JP | 55-107852 | A | 8/1980 |
| JP | 57014135 | A | 1/1982 |
| JP | 04080581 | A | 3/1982 |
| JP | 60259848 | A | 12/1985 |
| JP | 61-093332 | A | 5/1986 |
| JP | 1067552 | A | 3/1989 |
| JP | 01200166 | A | 8/1989 |
| JP | 02242052 | A | 9/1990 |
| JP | 03129260 | A | 6/1991 |
| JP | 04214167 | A | 8/1992 |
| JP | 05099514 | A | 4/1993 |
| JP | 05322412 | | 12/1993 |
| JP | 8-145414 | A | 6/1996 |
| JP | 9-89297 | A | 4/1997 |
| JP | 09089297 | A | 4/1997 |
| JP | 10-238810 | A | 9/1998 |
| JP | 2000234761 | A | 8/2000 |
| JP | 2001-065917 | A | 3/2001 |
| JP | 2001-182965 | A | 7/2001 |
| JP | 2001270326 | A | 10/2001 |
| JP | 2002061912 | A | 2/2002 |
| JP | 2002-188827 | A | 7/2002 |
| JP | 2002188827 | A | 7/2002 |
| JP | 2002-267204 | A | 9/2002 |
| JP | 2002355527 | A | 12/2002 |
| JP | 2003024737 | A | 1/2003 |
| JP | 2004271034 | A | 9/2004 |
| JP | 2004305995 | A | 11/2004 |
| WO | 91/16584 | A1 | 10/1991 |
| WO | 96/11049 | A1 | 4/1996 |
| WO | 2007/008948 | A1 | 1/2007 |

OTHER PUBLICATIONS

Material for Squirrel Cage Blower cited in the reexamination proceeding for U.S. Patent No. 7,246,503, Fluent, Inc., Copyright 2001, 2 pages.

Amendments to claims and specification in corresponding European Patent Application No. 10005307.3 dated Jun. 7, 2011.

Kilpatrick Stockton, LLP, Answers to Complaint, Affirmative Defenses and Counterclaims, dated Feb. 4, 2010.

Merchant & Gould, P.C., Answer and Counterclaims, dated Feb. 4, 2010.

Kilpatrick Stockton, LLP, Defendants' First Supplemental Disclosure of Invalidity Contentions for U.S. Patent Nos. 7,246,503, 7,281,389 and 7,540,166, dated Apr. 23, 2010.

EBAC Industrial Products, Inc., ORION Dehumidifier Flyer and Drawing, date unknown, Bishop Aukland, England/Great Britain.

Michael Best & Friedrich, LLP, Answer to First Amended Complaint and Affirmative Defenses, Jul. 13, 2009, Milwaukee, Wisconsin, USA.

Kilpatrick Stockton, LLP, Abatement Technologies, Inc.'s First Supplemental Responses to Plaintiffs' Interrogatories Nos. 5 and 6, Dec. 21, 200, Atlanta, Georgia, USA.

Bereskin & Parr, Preliminary Patentability Search Report, Dec. 13, 2007, Toronto, Ontario, Canada.

Dehumidification, Hawaii Commercial guidelines for Energy Efficiency, 2003.

Desert Aire IH/WC Series Dehumidifiers Brochure, 2005.

Fan Performance Characteristics of Centrifugal Fans, Engineering Data, 2000.

Kilpatrick Stockton, LLP, Defendant's First supplemental Disclosure of Invalidity Contentions for U.S. Patent Nos. 7,246,503; 7,281,389 and 7,540,166, Apr. 23, 2010.

Fan Selection and Sizing to Reduce Inefficiency and Low Frequency Noise Generation, Fan Noise, 2003.

Understanding Centrifugal Fans, Plant Engineering, Feb. 6, 1995.
Validation of a Dynamic Model for a Dehumidifier Wood Drying Kiln, Drying Technology, 1999.
Energy Efficient Electric Drying Systems for Industry, Drying Technology, 1995.
European Search Report received in corresponding European Patent Application No. 10005307.3, dated Sep. 10, 2010.

* cited by examiner

FIG. 2 PRIOR ART
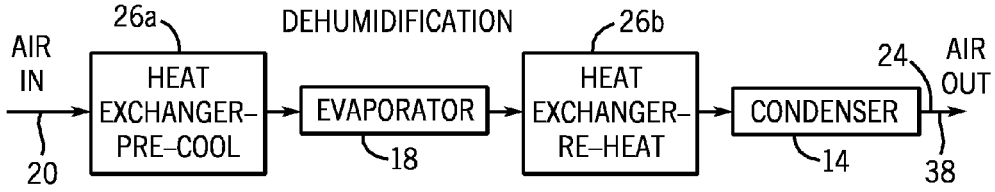
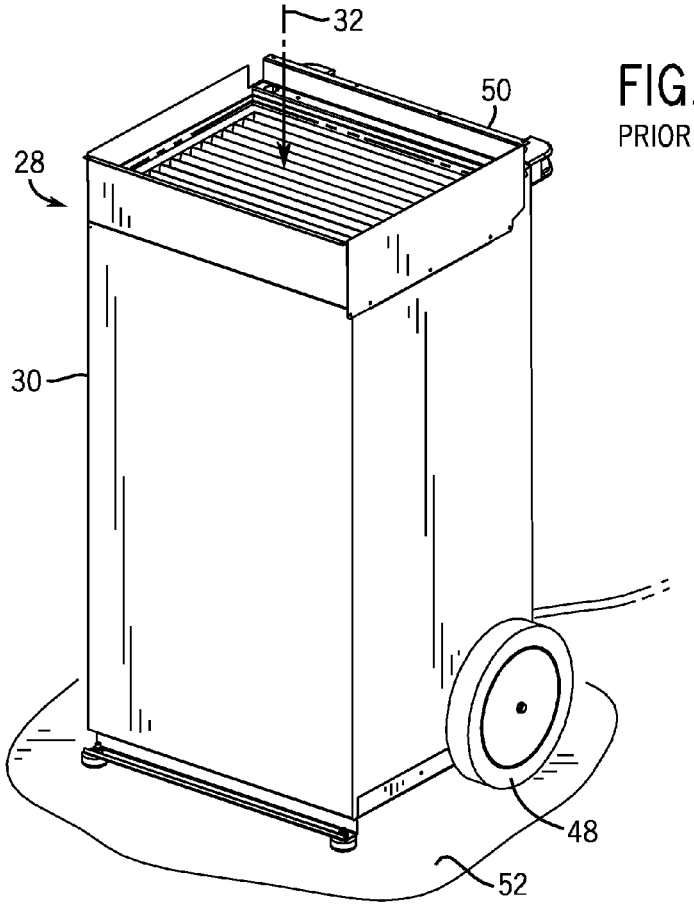
FIG. 3
PRIOR ART

ENHANCED PERFORMANCE DEHUMIDIFICATION APPARATUS, SYSTEM AND METHOD

CROSS-REFERENCE TO RELATED APPLICATIONS

This application is a continuation-in-part of U.S. patent application Ser. No. 11/872,106, filed Oct. 15, 2007 now U.S. Pat. No. 7,540,166. U.S. patent application Ser. No. 11/872,106 is a continuation of U.S. patent application Ser. No. 11/280,056, filed Nov. 16, 2005, now U.S. Pat. No. 7,281,389. U.S. patent application Ser. No. 11/872,106 and U.S. Pat. No. 7,281,389 are incorporated herein by reference.

BACKGROUND AND SUMMARY

Dehumidifiers are known in the prior art. A compressor delivers hot compressed refrigerant gas. A condenser receives the refrigerant gas and condenses same to hot refrigerant liquid. An expansion device receives the refrigerant liquid from the condenser and expands same to drop the temperature and pressure of the liquid. An evaporator receives the cool liquid refrigerant from the expansion device and evaporates same to cold gas refrigerant, which is returned to the compressor to complete the refrigeration cycle. Air flow is directed across the evaporator to cool the air below the dew point such that water vapor in the air is condensed to liquid to dehumidify the air. The dehumidified air is then directed across the condenser to warm the air.

The present invention arose during continuing development efforts directed toward improved performance and efficiency in a dehumidifier.

BRIEF DESCRIPTION OF THE DRAWINGS

FIG. 2 is a schematic illustration of a dehumidification system known in the prior art.

FIG. 3 is a perspective view showing a dehumidifier, including portable cabinet, known in the prior art.

DETAILED DESCRIPTION OF THE DRAWINGS

Prior Art

Figure 1:
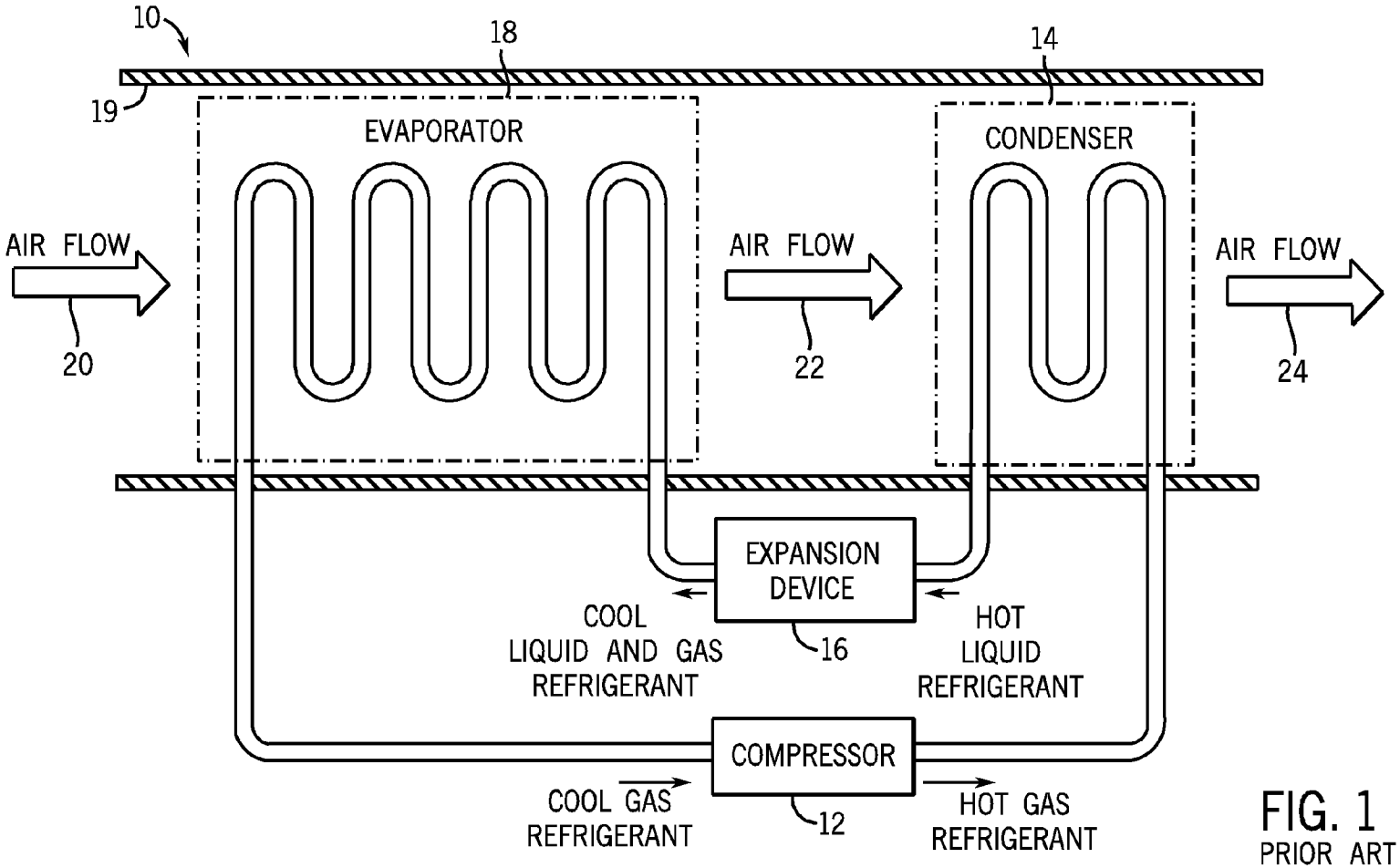
FIG. 1 PRIOR ART
FIG. 1 shows a dehumidifier known in the prior art and is taken from FIG. 1 of U.S. Pat. No. 5,031,411, incorporated herein by reference.

FIG. 1 shows a dehumidifier 10 known in the prior art. A compressor 12 delivers compressed hot gas refrigerant. A condenser 14 receives the hot gas refrigerant and condenses same to hot liquid refrigerant, and gives up heat to the air flow therethrough. An expansion device 16 receives the hot liquid refrigerant and expands same to a liquid and gas refrigerant mixture of reduced temperature and pressure. Expansion device 16 is typically a flow restrictor, capillary tube, or other pressure reducer. An evaporator 18 receives the cool liquid and gas refrigerant mixture and evaporates the liquid portion to cool gas refrigerant, and absorbs heat from the air flow therethrough. The refrigerant is circulated from compressor 12 to condenser 14 to expansion device 16 to evaporator 18 and back to compressor 12 in a refrigeration cycle. Air flow, typically driven by a fan (not shown), is directed by a duct or housing 19 along a path through evaporator 18 and condenser 14. As the air flows through evaporator 18 from point 20 to point 22, the temperature of the air drops below the dew point such that water vapor in the air is condensed to liquid to dehumidify the air. The air is heated as it flows through condenser 14 from point 22 to point 24, and the warmed and dehumidified air is discharged to the desired space, such as a basement, or other interior space of a house or building.

Figure 4:
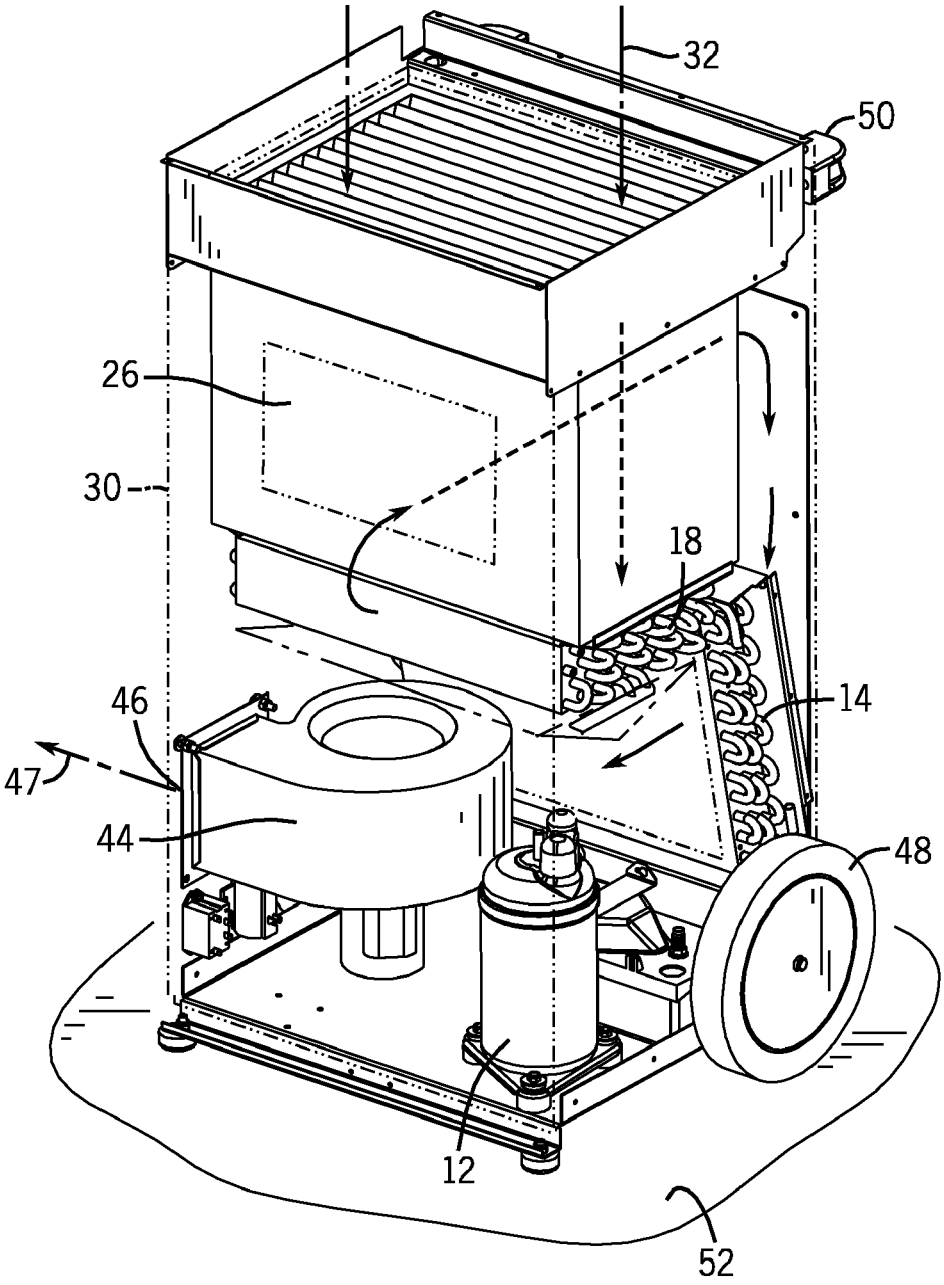
FIG. 4 PRIOR ART
FIG. 4 shows the dehumidifier of FIG. 3 partially broken away, showing prior art.
Figure 5:
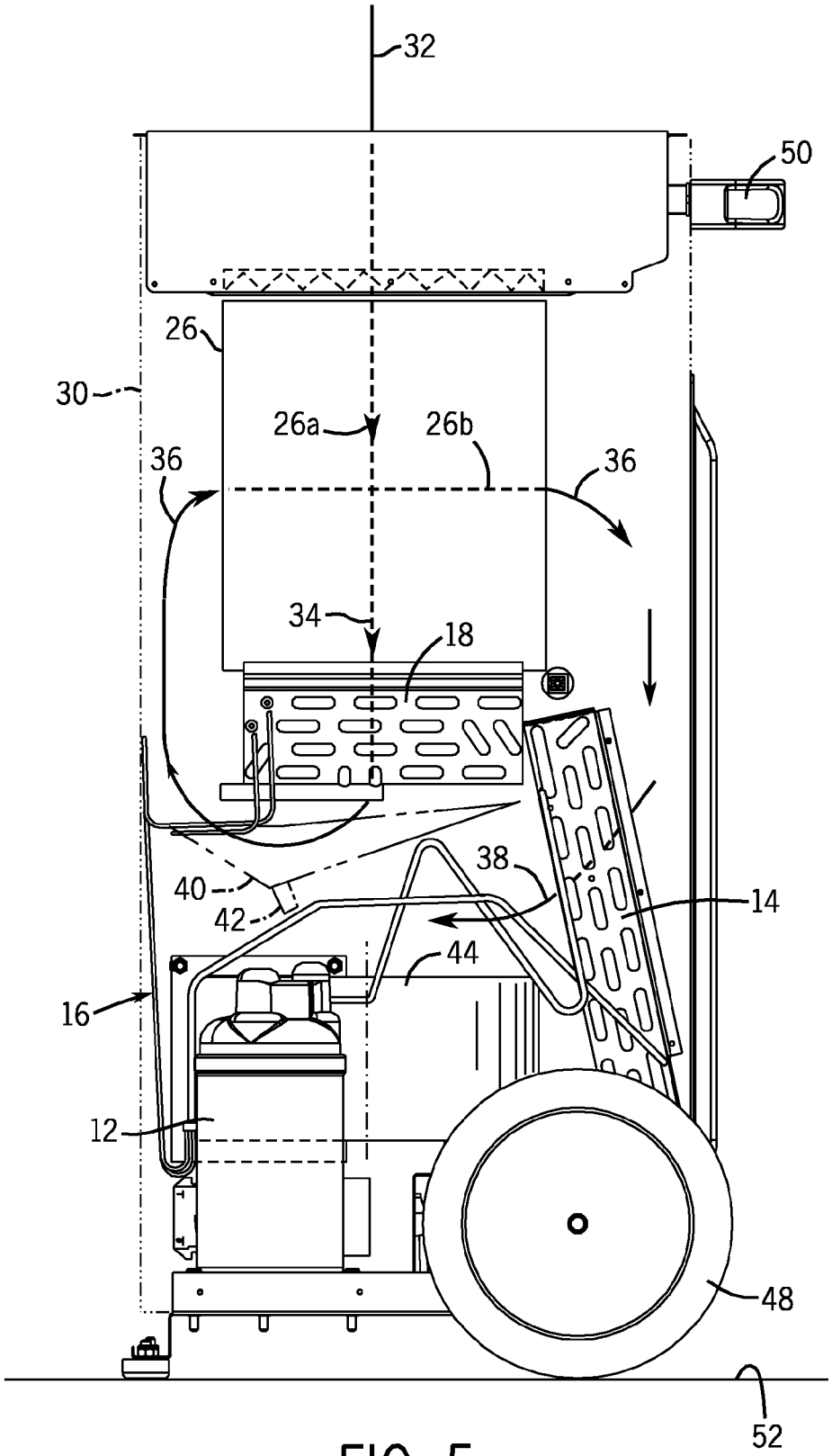
FIG. 5 PRIOR ART
FIG. 5 is a side view of the dehumidifier of FIG. 4, showing prior art.
Figure 6:
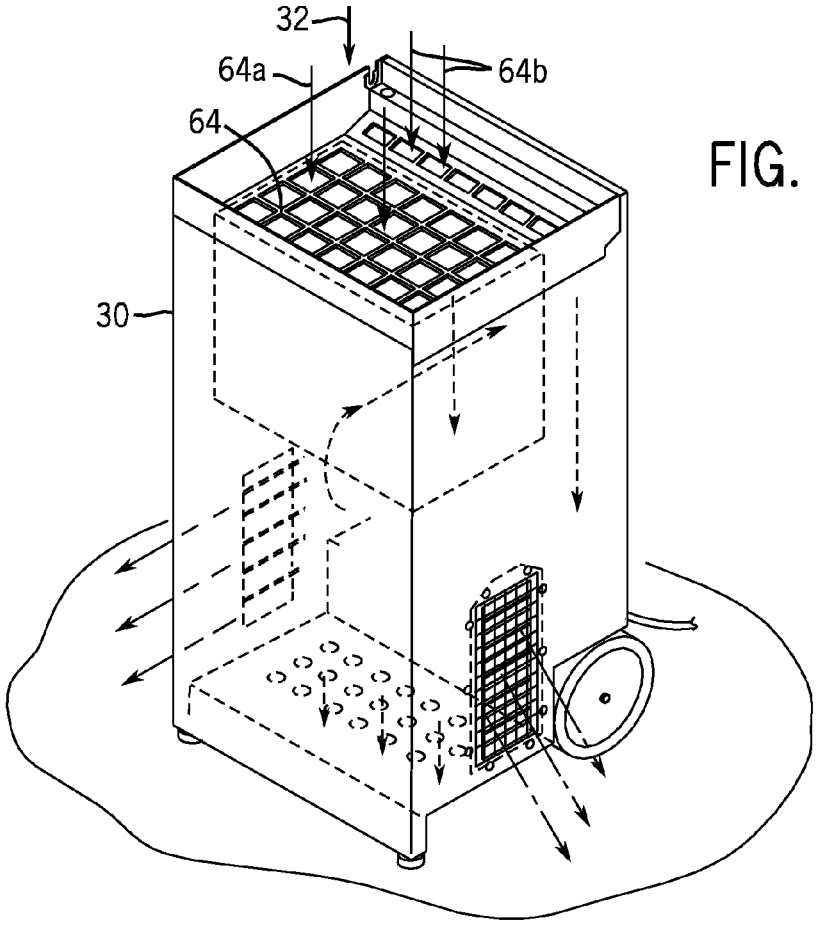
FIG. 6 is a perspective view of a dehumidifier, including portable cabinet, in accordance with the present invention.
Figure 7:
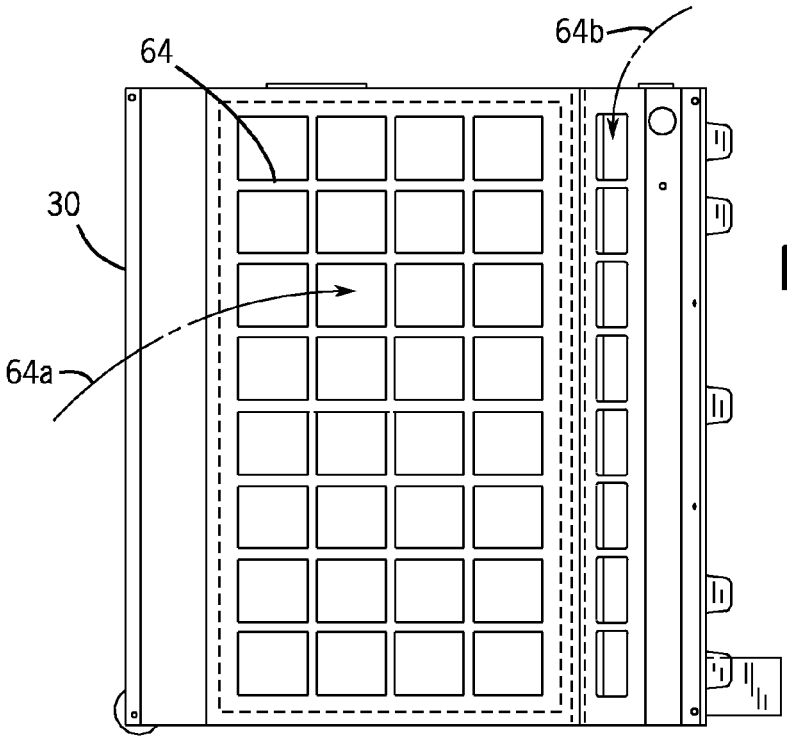
FIG. 7 is a top elevation view of the dehumidifier of FIG. 6.

FIG. 2 further schematically illustrates the dehumidification of system of FIG. 1 and uses like reference numerals where appropriate to facilitate understanding. It is known to provide a heat exchanger 26*a*, 26*b* for pre-cooling the air upstream of evaporator 18 and then re-heating the air downstream of the evaporator. FIGS. 3-5 show a dehumidifier 28 including a portable cabinet 30, compressor 12 in the cabinet for delivering hot compressed refrigerant, condenser coil 14 in the cabinet and receiving refrigerant from compressor 12 and condensing same, capillary tube expansion device 16 in the cabinet and receiving refrigerant from condenser coil 14 and expanding same, and evaporator coil 18 in the cabinet and receiving refrigerant from expansion device 16 and evaporating same, and delivering the refrigerant to compressor 12. The refrigerant is circulated from compressor 12 to condenser coil 14 to expansion device 16 to evaporator coil 18 and back to compressor 12 in a refrigeration cycle, as is known. Cabinet 30 has an air flow path 32 therethrough, including a first segment 34, FIG. 5, passing ambient air to evaporator coil 18, a second segment 36 passing air from evaporator coil 18 to condenser coil 14, and a third segment 38 discharging air from condenser coil 14. The first, second and third segments, 34, 36 and 38, are in series from upstream to downstream, respectively. Heat exchanger 26 has first and second heat exchange paths 26*a* and 26*b* therethrough in heat exchange relation, for example provided by a plurality of layered corrugated sheets providing vertical air flow channels therethrough at 26*a* in heat exchange relation with a plurality of interdigitated corrugated layered sheets providing horizontal flow channels therethrough at 26*b*, providing an air-to-air cross flow heat exchanger as is known. Heat exchanger path 26*a* provides pre-cooled ambient air from which moisture is removed by evaporator coil 18. The removed moisture is collected at collection pan 40 having drainage outlet 42. The air is re-heated at heat exchanger flow path 26*b*, and the warm dry air is supplied to condenser coil 14 as pulled therethrough by squirrel cage blower 44 which discharges the dehumidified air at outlet 46 as shown at arrow 47. Portable cabinet 30 may be mounted on wheels such as 48 and have a handle such as 50 for maneuvering the cabinet and rolling it along a floor such as 52.

Parent Application

FIGS. 6-19 illustrate the invention of the present application and use like reference numerals from above where appropriate to facilitate understanding.

Figure 8:
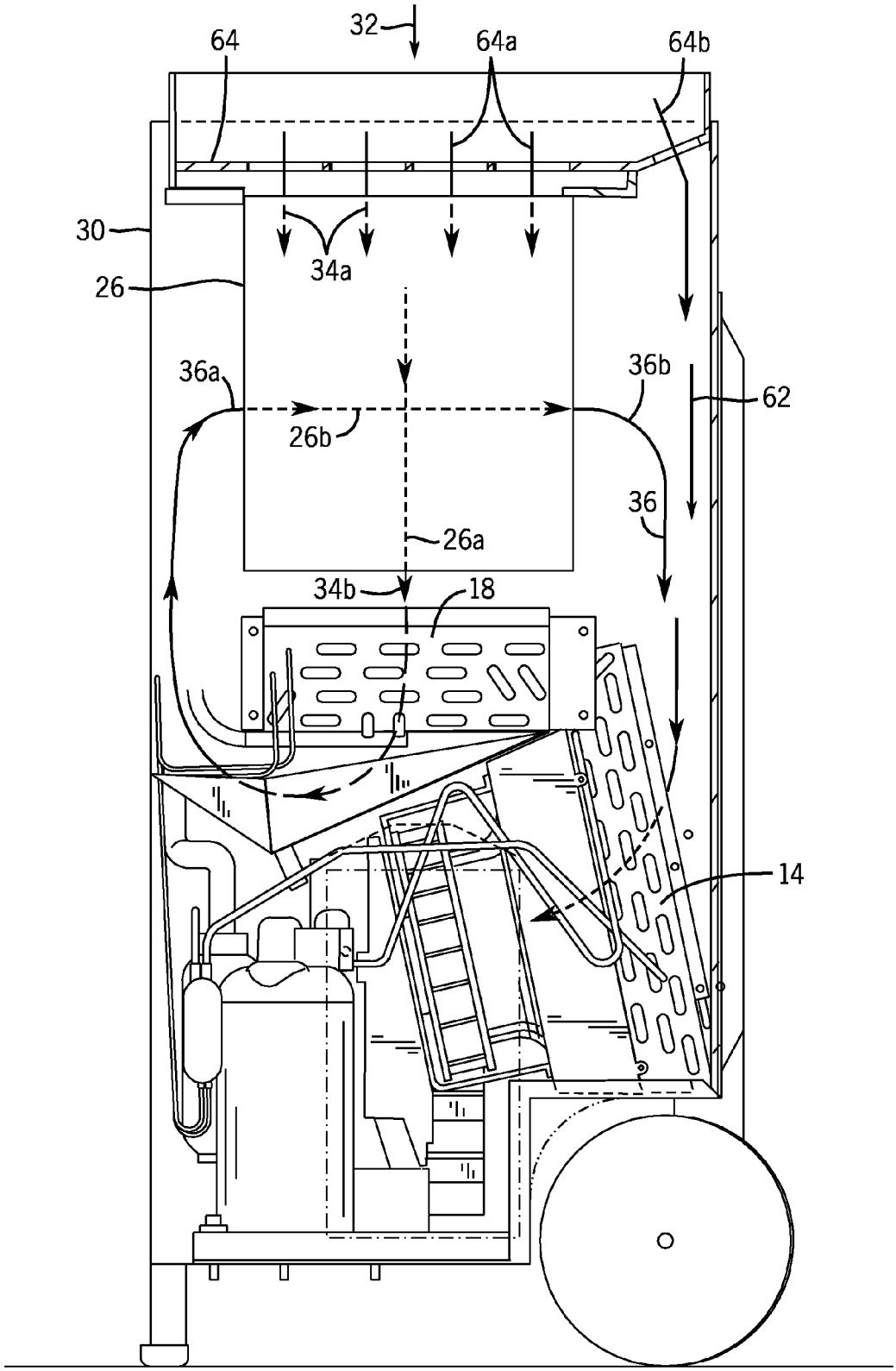
FIG. 8 is a side view, partially broken away, of the dehumidifier of FIG. 6.
Figure 9:
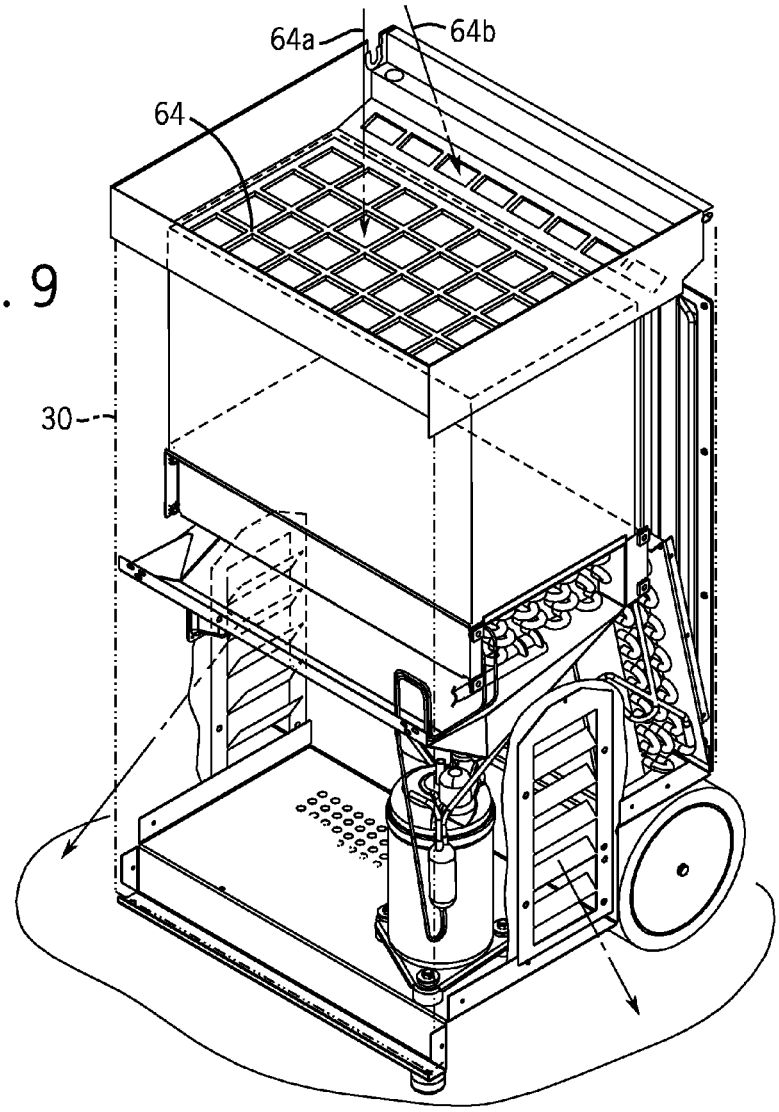
FIG. 9 is a perspective view, partially broken away, of the dehumidifier of FIG. 6.
Figure 10:
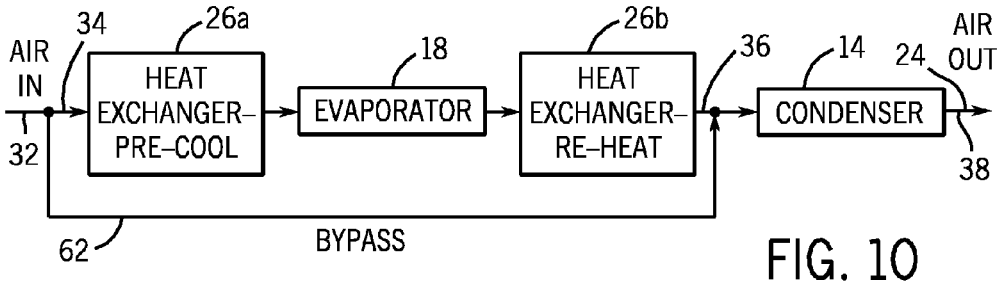
FIG. 10 is a schematic illustration of a dehumidifier in accordance with the invention.

In FIGS. 6-10, the air flow path has a fourth segment 62, FIG. 8, passing ambient air to condenser coil 14. Fourth segment 62 is in parallel with second segment 36 of the air flow path. First segment 34 of the air flow path has a first subsegment 34*a* supplying ambient air to first heat exchange path 26*a* of the heat exchanger, and has a second subsegment 34*b* supplying air from first heat exchange path 26*a* of the heat exchanger to evaporator coil 18. Second segment 36 of the air flow path has a third subsegment 36*a* supplying air from evaporator coil 18 to second heat exchange path 26*b* of the heat exchanger, and a fourth subsegment 36*b* supplying air from second heat exchange path 26*b* of the heat exchanger to condenser coil 14. Fourth segment 62 is in parallel with fourth subsegment 36*b*. Segment 62 of the air flow path merges with subsegment 36*b* of the air flow path downstream of second heat exchange path 26*b* of heat exchanger 26. Fourth segment 62 of the air flow path is in parallel with each of the noted first and fourth subsegments 34*a* and 36*b* of the air flow path. Cabinet 30 has an inlet at grate 64 receiving ambient air at 32 and having first and second branches 64*a* and 64*b*. First branch 64*a* provides the noted first segment 34 of the air flow path. Second branch 64*b* provides the noted fourth segment 62 of the air flow path. Fourth segment 62 of the air flow path bypasses evaporator coil 18, and preferably bypasses both heat exchanger 26 and evaporator coil 18. Fourth segment 62 of the air flow path merges with second segment 36 upstream of condenser coil 14. The arrangement enhances high temperature performance of the dehumidifier. More moisture is removed over a standard dehumidifier under high ambient temperature conditions. The present dehumidifier operation envelope is increased by bypassing a percentage of incoming ambient air around the evaporator and across the condenser. This extra air mixes with the air from the air-to-air cross flow heat exchanger 26 and lowers the condensing temperature. A lower condensing temperature extends the operation range using the same capacity compressor, evaporator and condenser coils.

Figure 11:
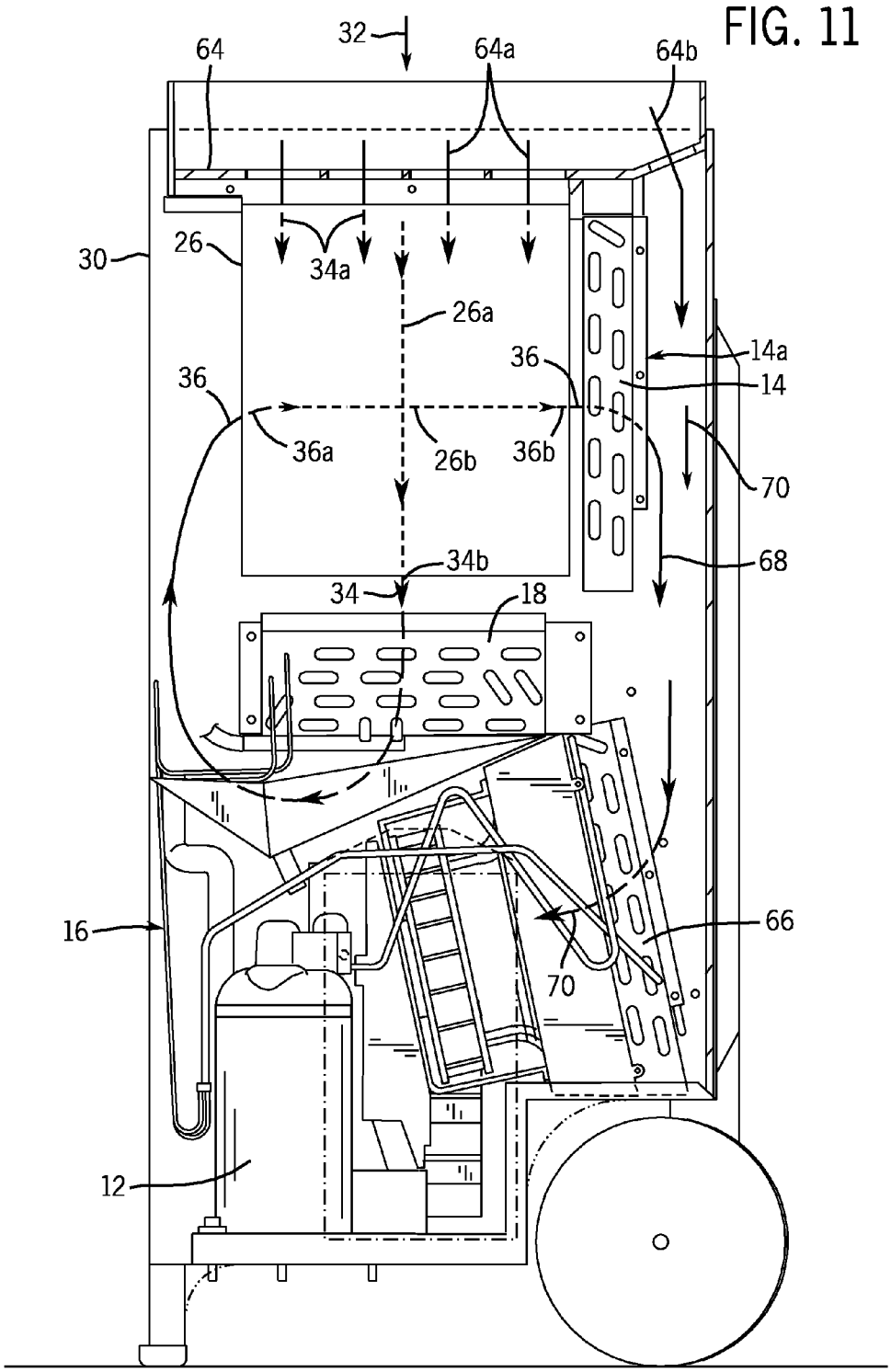
FIG. 11 is like FIG. 8 and shows a further embodiment.
Figure 12:
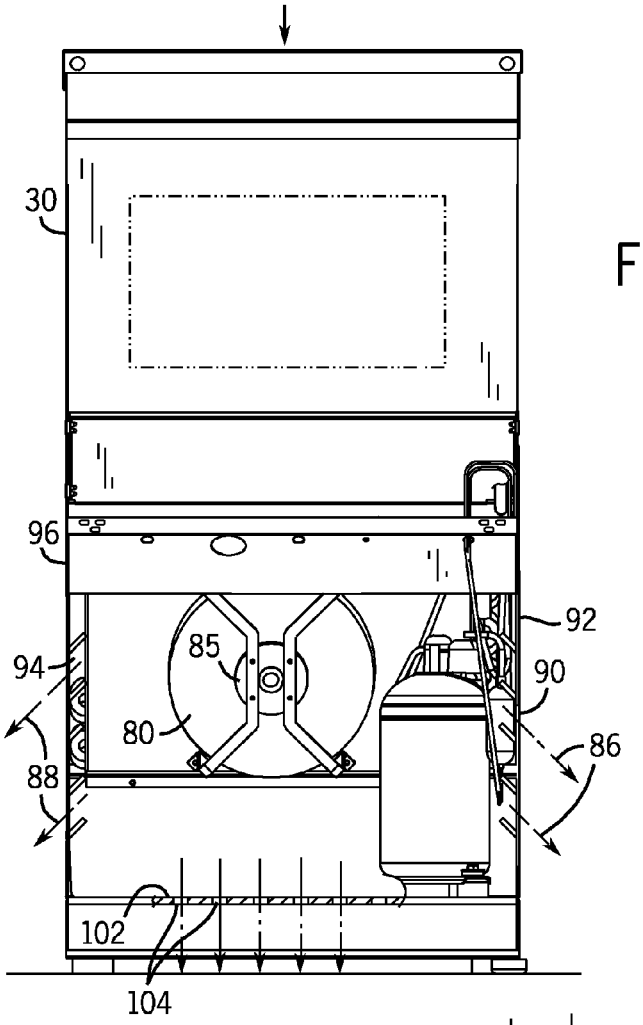
FIG. 12 is an end view, partially broken away, of the dehumidifier of FIG. 9.

In FIG. 11, a desuperheater coil 66 is provided in cabinet 30 and receives refrigerant from compressor 12 and condenses same, and condenser coil 14 is moved to location 14*a* and receives refrigerant from desuperheater coil 66 and condenses same and supplies the refrigerant to the expansion device as above. Refrigerant is circulated from compressor 12 to desuperheater coil 66 to condenser coil 14 at location 14*a* to expansion device 16 to evaporator coil 18 and back to compressor 12 in a refrigeration cycle. First segment 34 of the air flow path passes ambient air to evaporator coil 18. Second segment 36 passes air from evaporator coil 18 to condenser coil 14. A third segment 68 passes air from condenser coil 14 at location 14*a* to desuperheater coil 66. A fourth segment 70 discharges air from desuperheater coil 66. The air flow path has a fifth segment 70 passing ambient air to desuperheater coil 66. First, second, third and fourth segments 34, 36, 68 and 70 of the air flow path in FIG. 11 are in series from upstream to downstream, respectively, and fifth segment 70 is in parallel with third segment 68. Heat exchanger 26 has the noted first and second heat exchange paths 26*a* and 26*b* therethrough. First segment 34 of the air flow path has the noted first subsegment 34*a* supplying ambient air to first heat exchange path 26*a* of the heat exchanger, and second subsegment 34*b* supplying air from first heat exchange path 26*a* of the heat exchanger to evaporator coil 18. Second segment 36 of the air flow path has the noted third subsegment 36*a* supplying air from evaporator coil 18 to second heat exchange path 26*b* of the heat exchanger, and fourth subsegment 36*b* supplying air from second heat exchange path 26*b* of the heat exchanger to condenser coil 14 at location 14*a*. Fifth segment 70 of the air flow path is in parallel with the noted fourth subsegment 36*b* after the latter passes through the condenser coil. Fifth segment 70 of the air flow path merges with third segment 68 of the air flow path downstream of condenser coil 14 and upstream of desuperheater coil 66. Fifth segment 70 is in parallel with the noted first subsegment 34*a*.

Cabinet 30 in FIG. 11 has the noted inlet at grate 64 receiving ambient air at 32 and having the noted first and second branches 64*a* and 64*b*. First branch 64*a* provides first segment 34 of the air flow path. Second branch 64*b* provides the noted fifth segment 70 of the air flow path. Fifth segment 70 bypasses each of heat exchanger 26 and evaporator coil 18 and condenser coil 14. The arrangement removes more moisture than a standard dehumidifier under high ambient temperature conditions. The present dehumidifier operation envelope is increased by bypassing a percentage of incoming ambient air around the evaporator and across the desuperheater coil. This extra air mixes with the air from the condensing coil at location 14*a* and lowers the condensing temperature. The combination of desuperheater coil 66 and condenser coil 14 at location 14*a* captures the lower temperature air for condensing and the higher temperature mixed air for removing the superheat. This provides even greater efficiency than the arrangement of FIGS. 6-10. For example, the vapor temperature exiting the compressor 12 may typically be 140 to 150° F., but the condensing temperature may be about 120° F. This extra 30° F. of superheat is utilized by directing the bypass air at 70 across the desuperheater coil 66, which bypass air was not pre-cooled as is the air flow at 34. Separate coils may be used at 66 and 14*a*, or alternatively different sections of one coil may be used.

In FIGS. 12-19, squirrel cage blower 44 of FIG. 4 is replaced by an impeller 80 in cabinet 30 downstream of condenser coil 14 and drawing air through the cabinet from upstream to downstream, namely through the noted first, second and third segments 34, 36, 38 of the air flow path in FIGS. 6-10, respectively, and any further air flow path segments such as in FIG. 11. Impeller 80 is preferably a backward incline blade impeller, sometimes called a backward curved impeller, as readily commercially available, for example from Soler & Palau, Inc., 16 Chapin Road, Unit #903, P.O. Box 637, Pine Brook, N.J. 07058.

Figure 13:
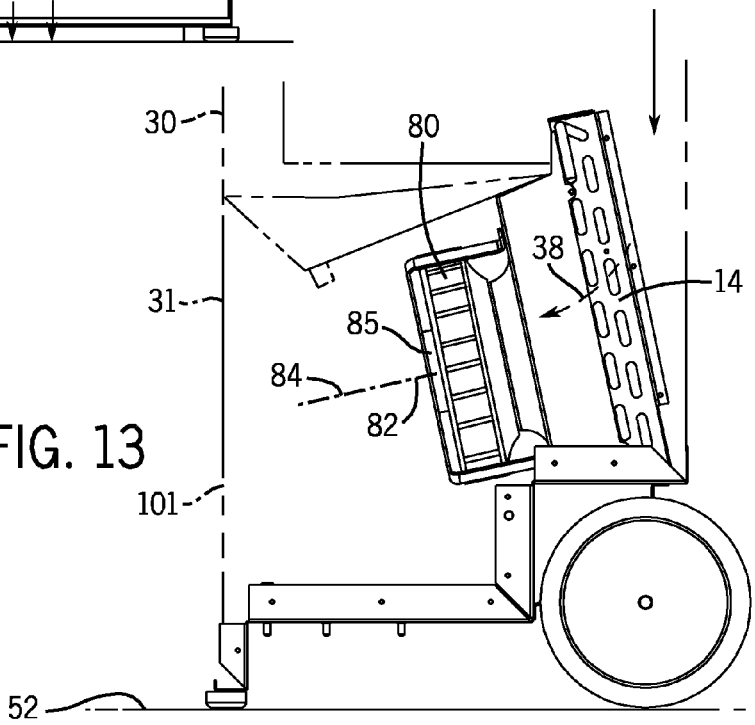
FIG. 13 is a side view, partially broken away, of a portion of the dehumidifier of FIG. 9.
Figure 14:
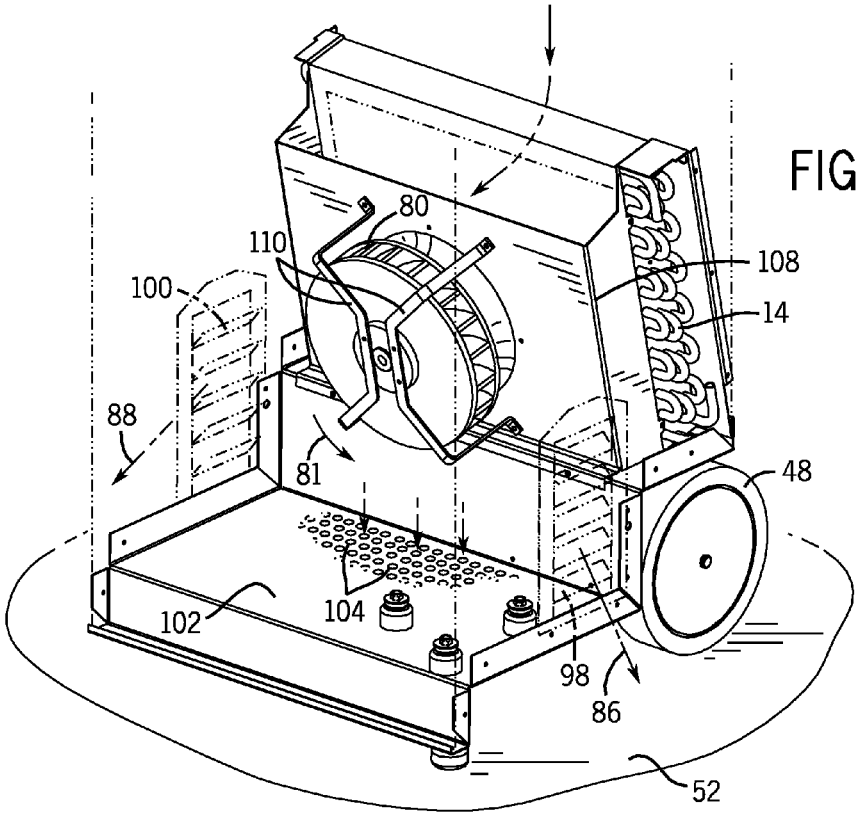
FIG. 14 is a perspective view of a portion of the structure of FIG. 9.
Figure 15:
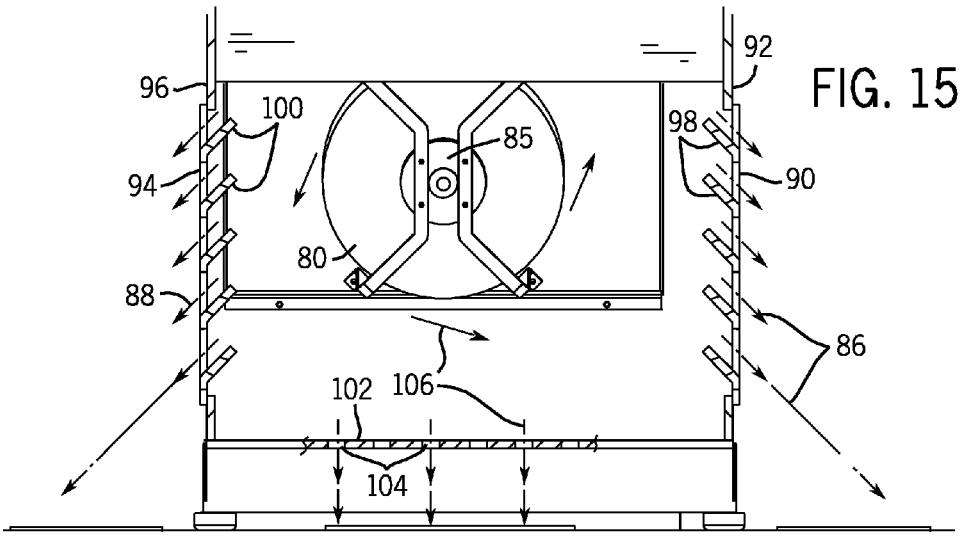
FIG. 15 is an end view of the structure of FIG. 14.
Figure 16:
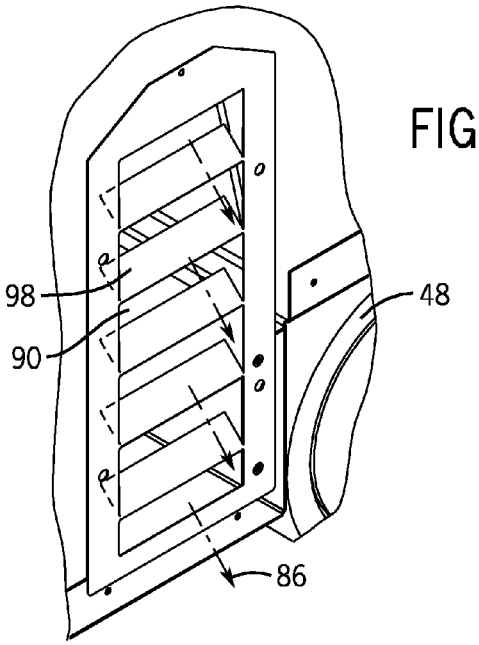
FIG. 16 is an enlarged perspective view of a portion of the structure of FIG. 9.
Figure 19:
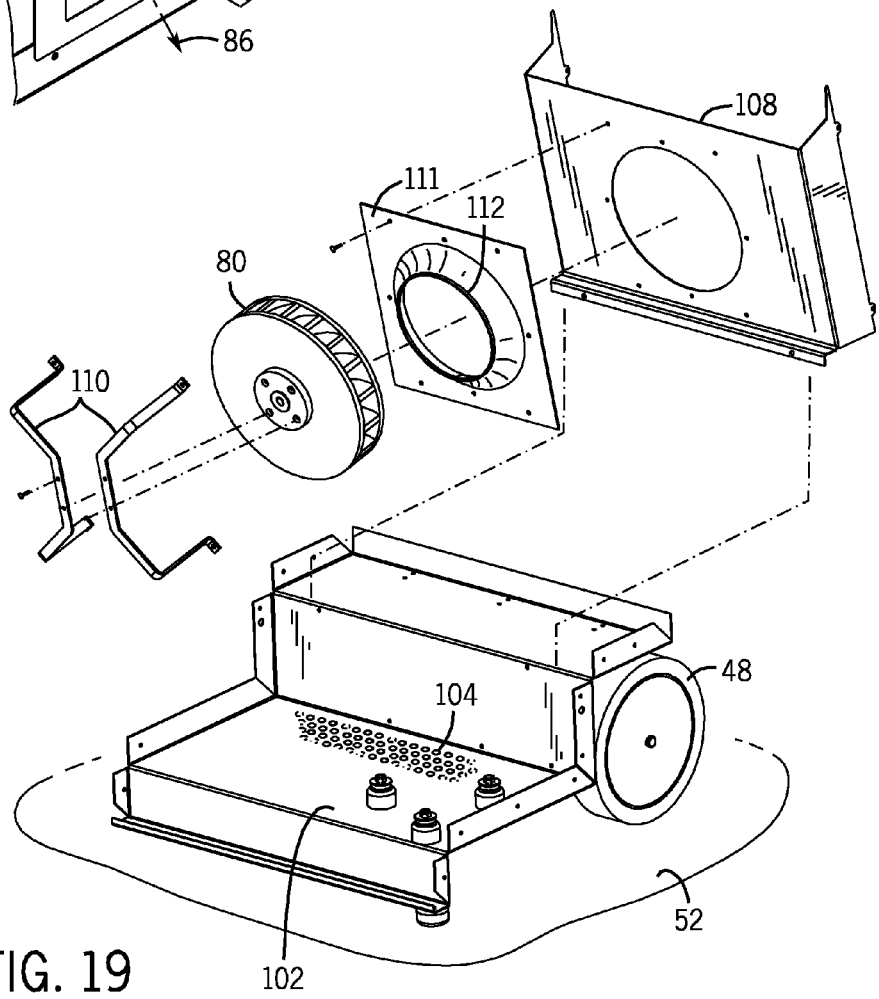
FIG. 19 is an exploded perspective view of the structure of FIG. 14.
Figure 17:
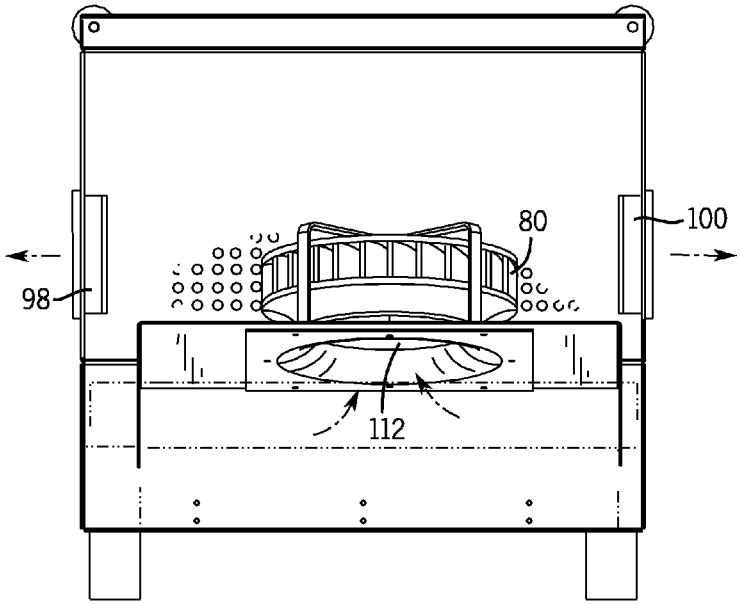
FIG. 17 is a top view of a portion of the structure of FIG. 14.
Figure 18:
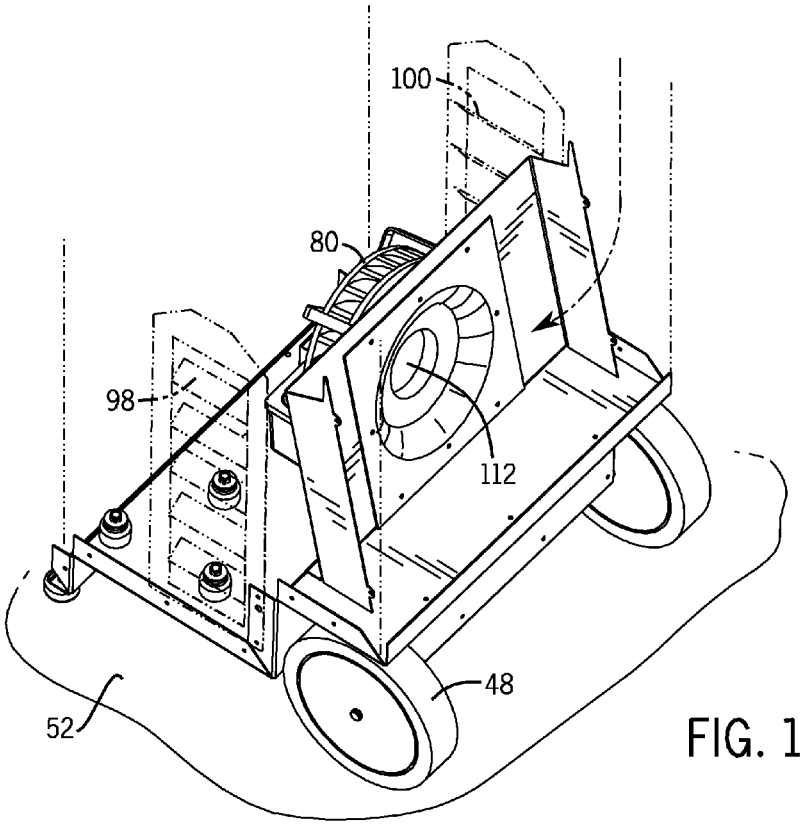
FIG. 18 is a perspective view of a portion of the structure of FIG. 14.
Figure 20:
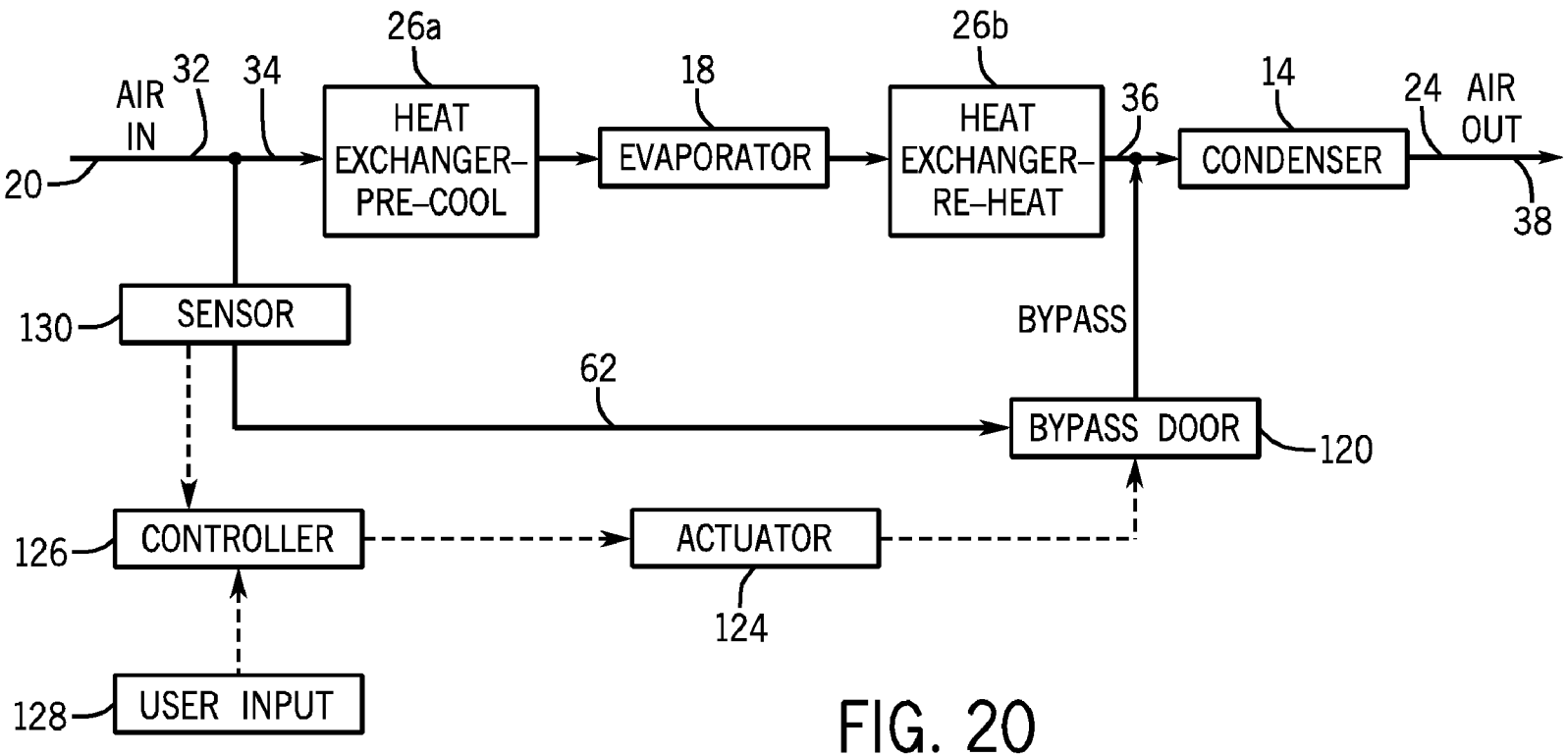
FIG. 20 is a schematic illustration of a dehumidification system in accordance with the invention.
Figure 21:
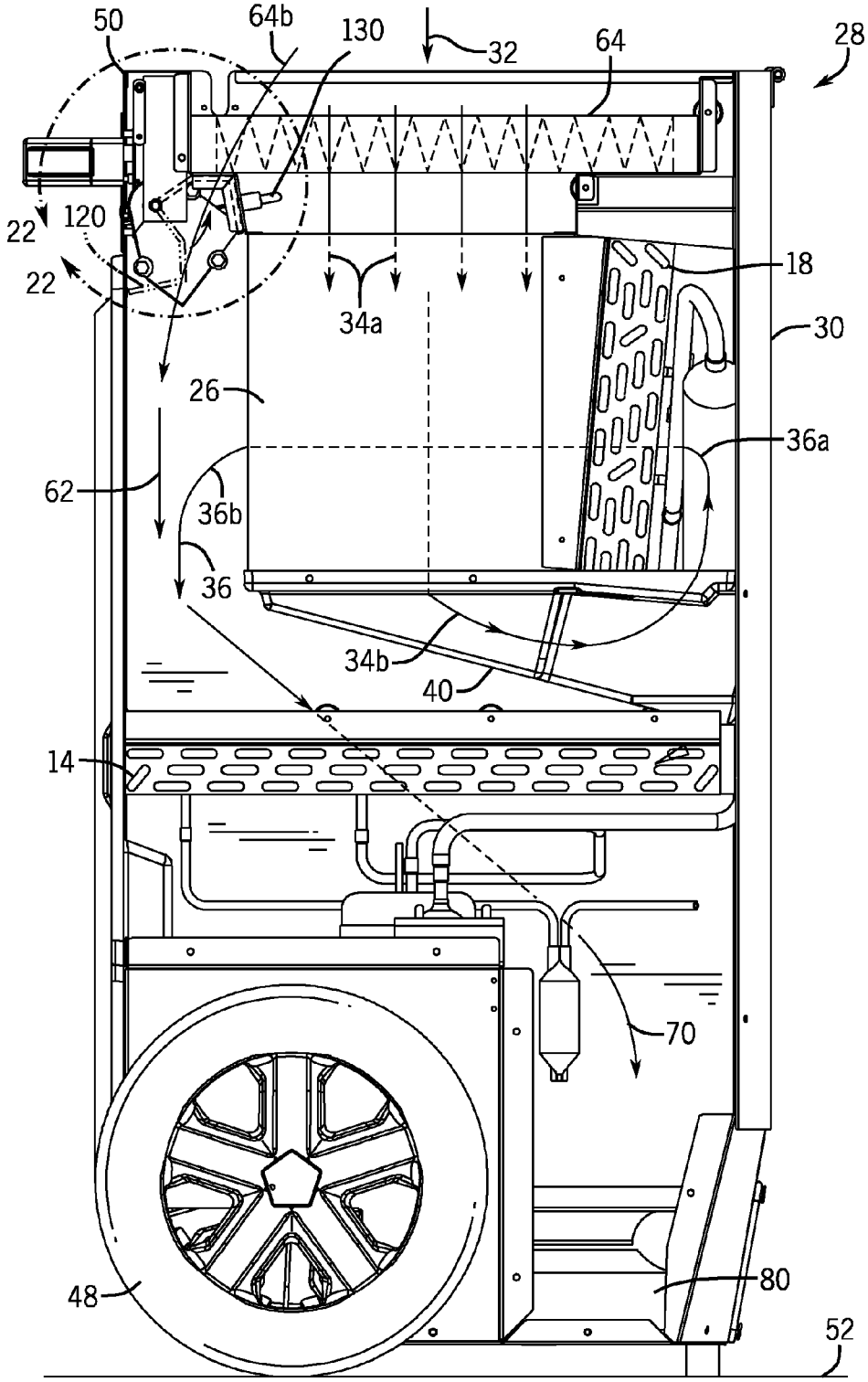
FIG. 21 is a side view, partially broken away, of a dehumidifier, including portable cabinet, in accordance with the present invention.
Figure 22:
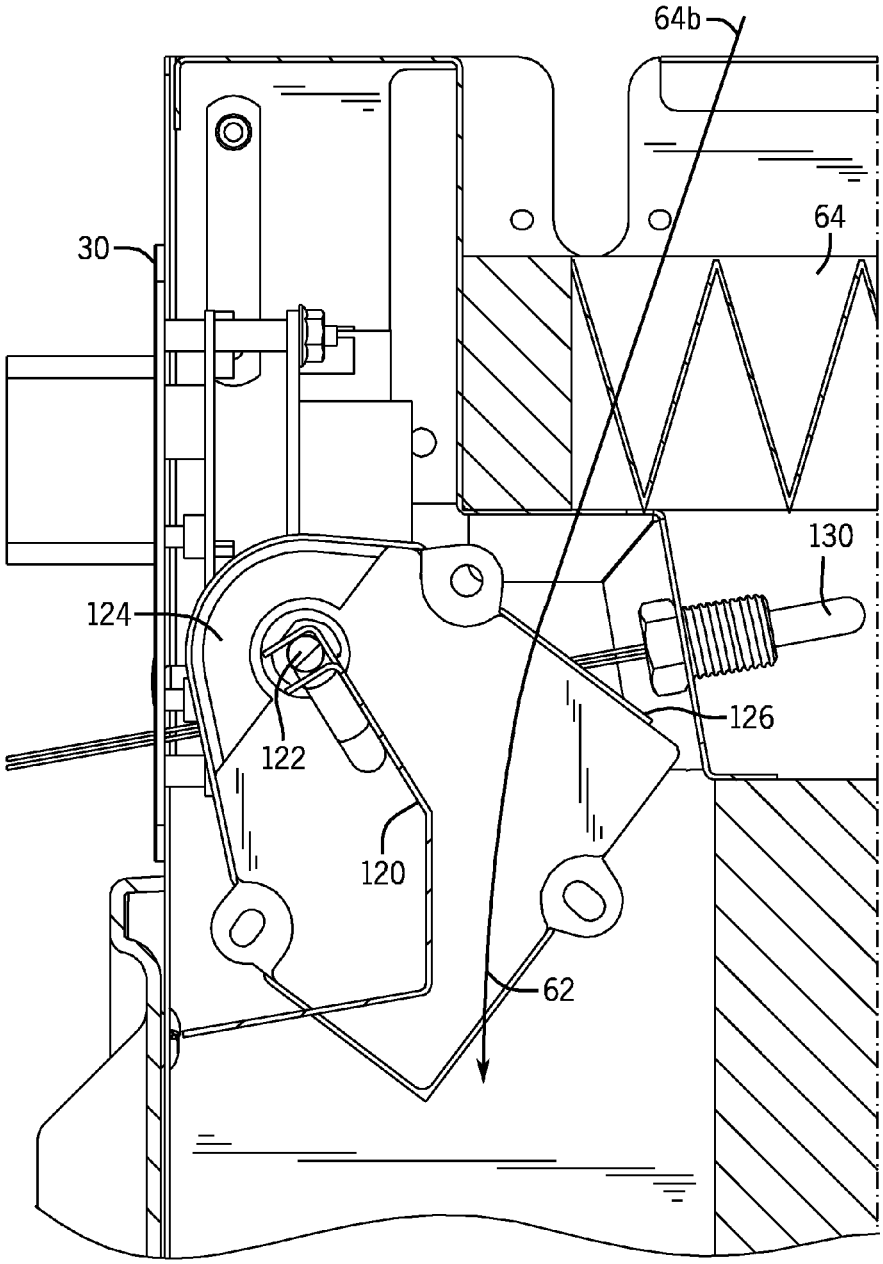
FIG. 22 is an enlarged view of section 22-22, taken in FIG. 21, showing a bypass door in an open position.
Figure 23:
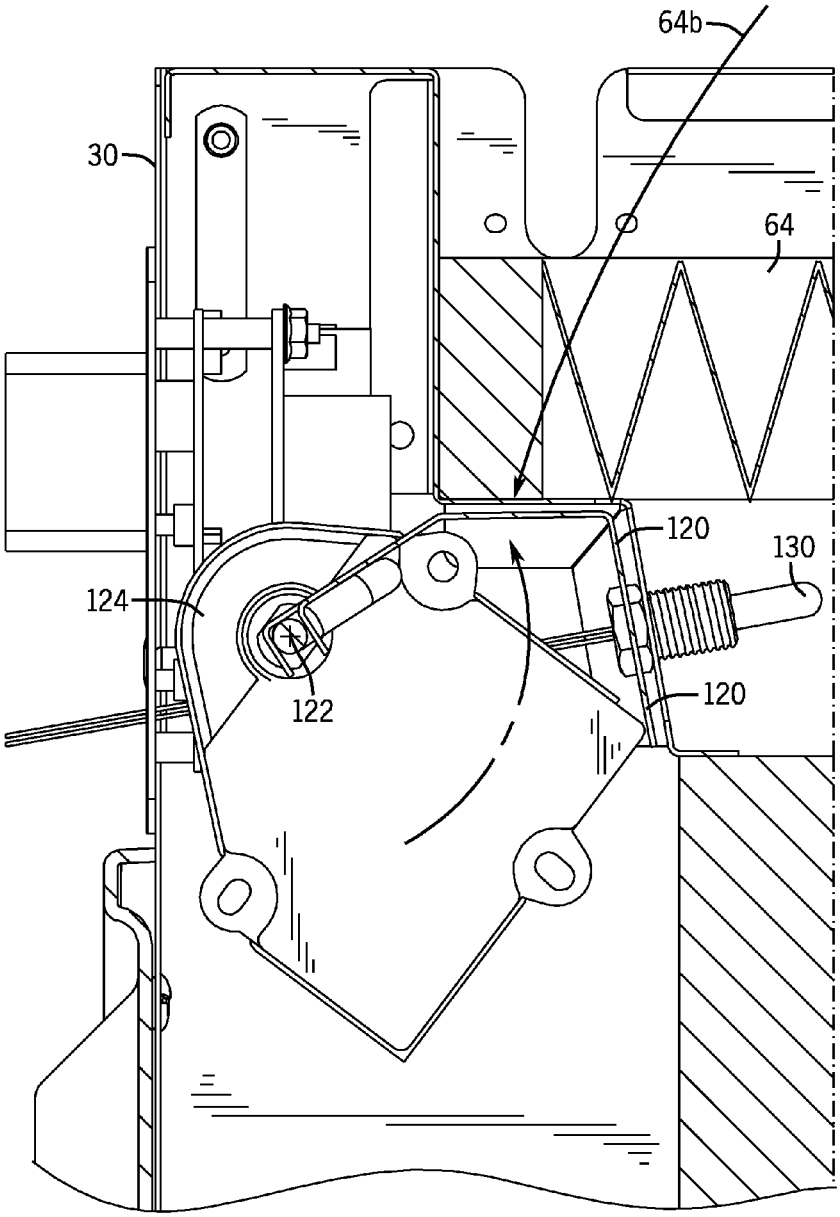
FIG. 23 is an enlarged view of section 22-22, taken in FIG. 21, showing the bypass door in a closed position.
Figure 24:
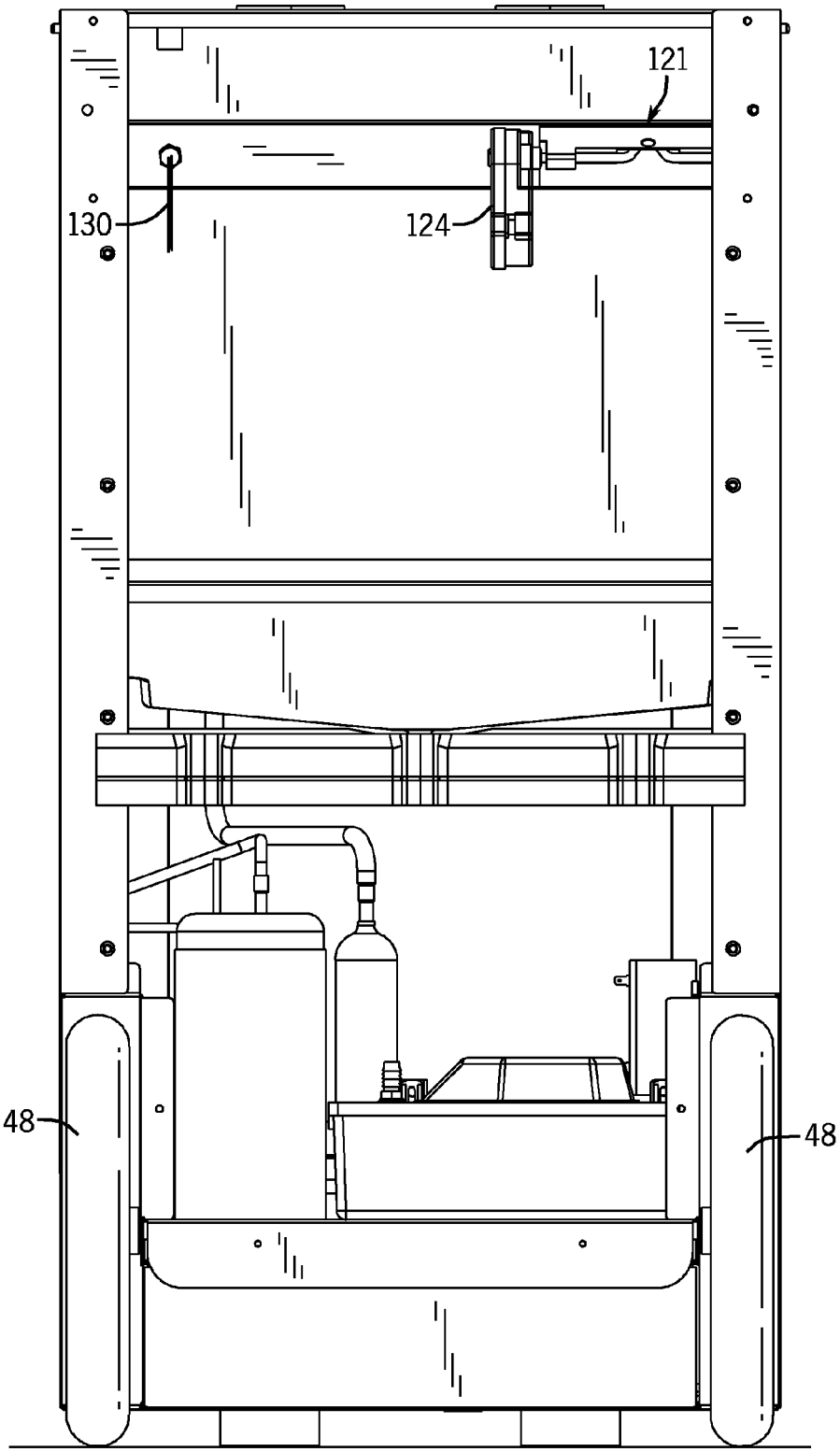
FIG. 24 is a rear view, partially broken away, of the dehumidifier of FIG. 21.
Figure 25:
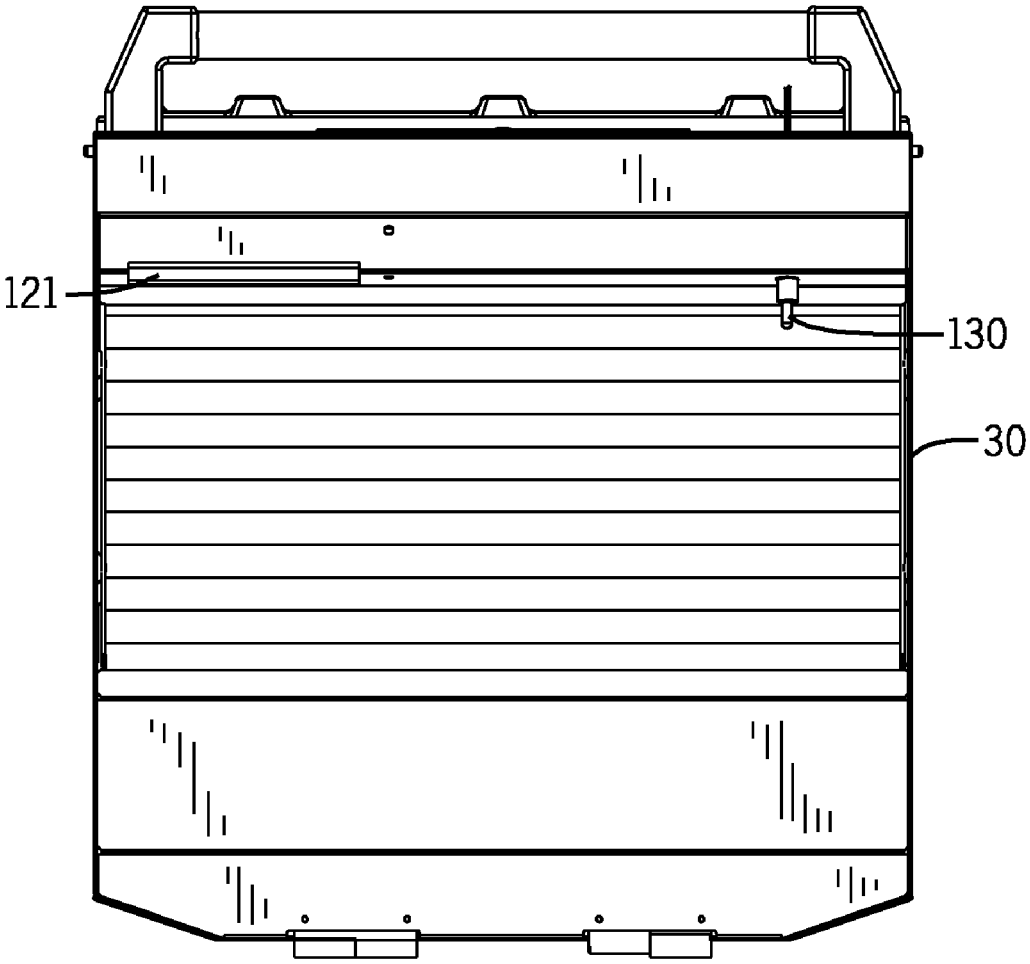
FIG. 25 is top view of the dehumidifier of FIG. 21.

Impeller 80 rotates about a rotation axis 82, FIG. 13, extending along an axial direction 84 and driven by a motor 85, as is known. As viewed in FIG. 14, impeller 80 rotates counterclockwise, as shown at rotational directional arrow 81. Third segment 38 of the air flow path extends axially along axial direction 84. The air flow path has a further segment 86, and preferably distally opposite segments 86 and 88, FIGS. 14, 15, discharging air from the impeller. Segments 86, 88 extend radially along respective radial directions relative to axial direction 84. Cabinet 30 has an air flow outlet provided by one or more openings 90 in a cabinet sidewall 92 distally oppositely spaced from impeller 80 along the noted radial direction, and has a second air flow outlet provided by one or more openings 94 in cabinet sidewall 96 distally oppositely spaced in the other direction from impeller 80 along the noted radial direction. Cabinet 30 is portable, as above noted, including along a floor such as 52. One or more deflectors 98, FIG. 15, direct exiting air downwardly through openings 90 in cabinet sidewall 92 towards floor 52 exteriorly of cabinet 30 to dry floor 52, such that the dehumidifier is also a water-damage-restoration drying fan. A second set of one or more deflectors 100 direct exiting air downwardly through openings 94 in cabinet sidewall 96 towards floor 52 exteriorly of cabinet 30 to dry floor 52. The respective cabinet sidewall has one or more louvers extending thereacross and angled downwardly to provide the noted sets of deflectors 98, 100. In further embodiments one or more openings 101 may be provided in cabinet front wall 31 along axial direction 84, providing an air flow outlet therethrough.

Cabinet 30 has a bottom wall 102 with one or more openings 104 therein. The air flow path has a segment 106 passing air from impeller 80 through the one or more openings 104 in bottom wall 102. The dehumidifier thus has plural air flow outlets, including the air flow outlet along segment 86 through opening 90 in cabinet sidewall 92, the air flow outlet along segment 88 through opening 94 in cabinet sidewall 96, and the air flow outlet along segment 106 through opening 104 in bottom wall 102 of the cabinet. The cabinet includes a plenum wall 108 between condenser coil 14 and impeller 80 and mounting the latter thereto at a pair of brackets 110 and having a shroud 111 with an opening 112 therethrough for communicating air from coil 14 to impeller 80 which in turn creates a negative pressure chamber drawing air from upstream to downstream as above noted, through coil 14 and opening 112 for discharge at flow path segments 86, 88, 106. The arrangement provides improved water restoration dehumidification particularly along floor 52 including underneath the dehumidifier cabinet 30, eliminating moisture shadows underneath the unit and in turn alleviating the need for service personnel to return periodically, e.g. the following day, to relocate the unit to otherwise dry the noted shadow. The backward incline blade impeller improves space efficiency for mounting, air volume, and the amount of air flow per current draw over a centrifugal blower such as a squirrel cage blower at the same air flow conditions. The louvered exits direct the warm dry air downwardly toward the high moisture floor instead of merely allowing dissipation of exiting dry air to the surroundings. This directed air flow enables the dehumidifier to function as a fan (e.g. for water damage restoration) in addition to being a dehumidification device. Solution of the noted moisture shadow problem is optional, through desirable and readily achievable by directing warm dry air underneath the unit as noted.

Present Application

FIGS. 20-26 illustrate examples of the presently claimed invention and use like reference numbers from above where appropriate to facilitate understanding.

FIGS. 20-25 depict a bypass door 120 that is selectively positionable to block air flow along the noted fourth segment 62 and alternately to allow air flow along the fourth segment 62. The bypass door 120 is movable between an open position (FIG. 22) to allow air flow along the fourth segment 62 and a closed position (FIG. 23) to block air flow along the fourth segment 62. In the example shown, the bypass door 120 includes an angled plate that is pivotally connected to a rotatable door rod 122 to open a bypass opening 121 in the open position (FIG. 22) and close the bypass opening 121 in the closed position. Other configurations of a bypass door could be employed to accomplish the functional objectives described herein.

The bypass door 120 can be moved between the noted open and closed positions manually or automatically by for example a mechanical or electro-mechanical actuator. In the example shown, an electro-mechanical actuator 124 including an electric motor is operatively coupled to the bypass door 120 via the door rod 122. Actuation of the actuator 124 causes rotation of the door rod 122 about its longitudinal axis P, which in turn causes the bypass door 120 to pivot (arrow A) about the axis P into and out of the noted open and closed positions. In the preferred example, the actuator 124 is a 12 UDC positional actuator, commercially produced and sold by Johnson Electric, North America.

Other types of actuators could be employed to accomplish the functional objectives described herein. For example, the actuator 124 could include a bimetallic disc or lever configured to move the bypass door 120 into a predetermined location. As the bimetallic disc springs from one location to another, the bypass door 120 would be driven, for example, into or out of the open or closed position. The disc/lever could be configured to actuate the door directly or to drive an electric motor to move the door. In another example, the bimetallic disc or lever could be configured to snap into position as it responds to a given air inlet ambient air temperature or evaporator outlet temperature. Alternatively, the bimetallic disc or lever could snap into position as it responds to a given dehumidifier refrigerant suction, discharge or liquid temperature.

In the example shown, a controller 126 is configured to selectively actuate the actuator 124 and to thereby selectively move the bypass door 120 between the noted open and closed positions. The controller 126 includes a programmable processor having a memory and an operating platform capable of receiving input data from a user input 128 and one or more sensors 130 and providing output data/instructions to control operation of the actuator 124. In the example shown, the controller 126 is housed in the dehumidifier 10 and communicatively coupled to the actuator 124, an optional user input device 128, and one or more sensors 130 by wired communication links. Alternately, the controller 126 can be located remotely from the dehumidifier and communicatively coupled to the actuator 124, an optional user input device 128, and one or more sensors 130 by a wireless link, including for example a LAN, WLAN, internet, intranet connection and/or the like. In the example shown, the communication links are capable of communicating real time data between the sensor 130 and the controller 126 and optionally the user input 128 and capable of providing real time output instructions to the actuator 124. In a preferred example, the controller 126 is a solid state programmable controller, commercially available from ITW/Arkles Corp. Other types of controllers could be employed to accomplish the functional objectives described herein.

In a preferred example, the controller is programmed with one or more algorithms (as described hereinbelow) to control movement of the bypass door 120 into and/or out of the noted open and closed positions, or to an alternate optimal door position, as described hereinbelow, based upon a parameter sensed by the sensor 130. Optionally, the system can include a user input device 128, which can include any type of user interface configured for input of control instructions to the controller 126. In one example, the user input device 128 includes a display panel have input buttons configured to receive user instructions pertaining to operation of the actuator 124 (i.e. instructions to move the bypass door 120 into or out of the noted open and closed positions, or to an alternate optimal door position, as described hereinbelow) and optionally a display screen for displaying a current operational state or parameter associated with the bypass door 120 and/or dehumidifier 10.

One or more sensors 130 are configured to sense an operational parameter of the dehumidifier 10 and to communicate the sensed parameter to the controller 126 via the noted communication link. In the example shown, the sensor 130 includes a thermistor attached to the dehumidifier 10 in a position to sense a condition of ambient air received at 32, such as the temperature of the ambient air or the relative humidity of the ambient air. A preferred sensor of this type is Therma-stor PN 402858 made commercially by Arkless. Other types of sensors could be employed to accomplish the objectives described herein.

In use, the sensed parameter is communicated to the controller 126, which is configured to compare the parameter to a predetermined range of parameters stored in its memory. Based upon this comparison, the controller 126 actuates the actuator 124 when the controller 126 determines that the sensed parameter is inside or outside of the stored predetermined range. In a preferred example, the controller 126 can be configured such that if it determines that the ambient air temperature sensed by sensor 130 is less than 85 degrees Fahrenheit, it actuates the actuator 124 to close the bypass door 120. If the sensed ambient temperature is greater than 90 degrees Fahrenheit, the controller 126 actuates the actuator 124 to open the bypass door 120.

In another preferred example, the controller 126 is configured to identify an optimal bypass door position between the noted open and closed positions based upon a comparison of the sensed parameter to the predetermined range, and then to move the bypass door 120 to the optimal bypass door position. Thus the bypass opening 121 can be partially opened or closed by the bypass door 120. For example, ambient temperatures that are sensed to be within a range of 81 and 89 degrees Fahrenheit can result in the controller 126 rotating the bypass door 120 away from a mid position between open and closed positions, according to a look-up table stored in the memory of the controller 126, as follows:

| Sensor Temperature F. | Door Position Degrees |
|---|---|
| 81 | 40 clockwise (CW) |
| 82 | 28 CW |
| 83 | 15 CW |
| 84 | 2 CW |
| 85 | 14 counterclockwise (CCW) |
| 86 | 24 CW |

-continued

| Sensor Temperature F. | Door Position Degrees |
|---|---|
| 87 | 37 CCW |
| 88 | 40 CCW |
| 89 | 53 CCW |

In another example, the sensor 130 can be configured and positioned on the dehumidifier 10 to sense other operational parameters of the dehumidifier 10, upon which the controller 126 would actuate the actuator 124 and thus the bypass door 120. For example, the sensor 130 can be configured to sense refrigerant temperature, refrigerant suction pressure, and/or refrigerant discharge pressure. The controller 126 would then follow similar comparison logic to that provided above to position the bypass door 120 into and out of the closed position, or to another identified optimal door position if the sensed parameter is outside of a predetermined range.

Figure 26:
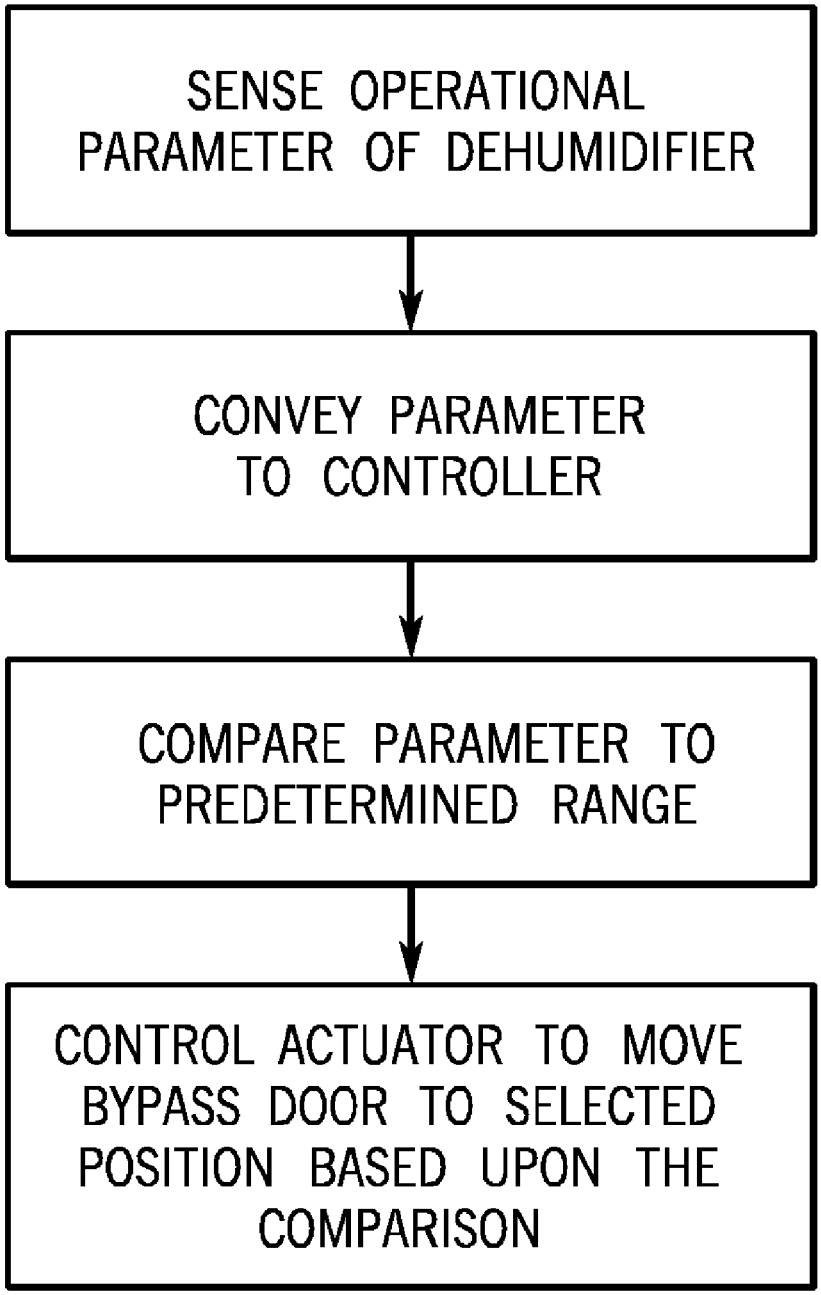
FIG. 26 is a flow chart illustrating steps in a method according to the present invention.

FIG. 26 is a flowchart illustrating an example of a method according to the present application. An operational parameter of the dehumidifier 10 is sensed and conveyed to the controller 126. The parameter is thereby compared to a predetermined range of parameters. This comparison allows the controller 126 to selectively actuate the actuator 124 to move the bypass door 120 to a selected position (i.e. open, closed, or identified optimal door position) based upon the comparison that is made.

A system according to the present application can include the noted dehumidifier 10 having a bypass door 120 selectively positionable to block air flow along the fourth segment 62 and alternatively to allow air flow along the fourth segment 62, an actuator 124, and a controller 126 configured to selectively actuate the actuator 124 and thereby selectively move the bypass door 120 between the open and closed positions. One or more sensors 130 can be associated with the dehumidifier 10 and configured to sense an operational parameter of the dehumidifier 10 and to communicate the sensed parameter to the controller 126, allowing the controller 126 to actuate the actuator 124 based upon the sensed parameter. In a preferred embodiment, the controller 126 compares the sensed parameter to a predetermined range of parameters and then actuates the actuator 124 based upon the comparison. The controller 126 can include a memory stored with the noted predetermined range of parameters and an operating platform that is configured to compare the sensed parameter to the predetermined range of parameters and then to actuate the actuator 124 when the sensed parameter is outside of the predetermined range.

The above-described apparatus, system and method allows for operation of the dehumidifier 10 at optimum performance levels, by either continuously or periodically changing the amount of air bypassing the evaporator 18 and heat exchanger 26 depending for example upon ambient conditions. Provision of the bypass flow 62 reduces the air pressure drop across the entire dehumidification system. Reduced system air pressure drop translates to additional system air flow generated by the air mover. Additional air flow is directed through the condenser. In high temperature applications, additional air flow across the condenser increases condenser heat rejection, which lowers refrigeration high pressure and thus extends operating range. This increases the refrigeration system coefficient of performance (COP). Air flow traveling into the dehumidifier 32 (FIG. 21) is diverted into flow streams **34*a* and 62. Provisions of the bypass flow 62 diverts a portion of air normally intended for stream 34*a* reducing the airflow across the evaporator 18**. Each amount of air pulled across evaporator contains an amount of sensible heat. Under low humidity high temperature conditions the percentage of sensible heat increases per unit air flow. A given compressor provides a certain amount of capacity. Reducing the airflow under low humidity high temperature conditions reduces the amount of sensible heat required to be removed by compressor capacity per unit air flow. The compressor spends a larger portion of its available power removing latent heat (water) from the air increasing dehumidifier capacity.

The above-described apparatus, system and method thus allows for selective opening of the bypass flow at high temperature conditions to achieve increased capacity and efficiency. Conversely, at lower, medium ambient temperatures/relative humidity conditions, the amount of sensible energy (Btu/lb) that needs to be removed while reaching the dew point is reduced. The refrigeration system thus spends a higher percentage of its energy removing the latent heat (water) from the air, increasing capacity. However a certain temperature is reached wherein the compressor in the refrigeration system overcomes any advantage gained by bypassing air flow around the evaporator and heat exchanger. The refrigeration COP becomes less affected by the high side refrigerant pressure as the air inlet temperature drops. The low side refrigerant pressure becomes the driving function of the COP as the inlet refrigerant pressure drops. At lower refrigerant pressures, the evaporator requires additional load to raise the refrigerant pressure to maintain high COP (efficiencies). Thus, closing the bypass door 120 diverts additional air flow (heat load) to the evaporator and/or heat exchanger.

The present invention thus provides increased efficiency and capacity compared to the prior art. Maintaining the bypass door 120 open provides advantages for high ambient temperature applications. Maintaining the bypass door 120 closed provides advantages for medium temperature applications.

The present invention also provides significant commercial advantages over the prior art. Faster drying periods through maximization of efficiencies and/or capacity throughout the dry-down cycle can be obtained provided. The described example allows for hands-free operation and easy setup, and minimizes defrost periods by ensuring the air flow, when required, is not bypassing the evaporator and increasing the load on the evaporator. Increased load on the evaporator warms the refrigerant temperature, thus postponing defrost conditions.

It is also recognized that various equivalents, alternatives and modifications are possible within the scope of the appended claims.

What is claimed is:

1. A dehumidifier comprising:

a cabinet;

a compressor in the cabinet for delivering hot compressed refrigerant;

a condenser coil in the cabinet and receiving refrigerant from the compressor and condensing same;

an expansion device in the cabinet and receiving refrigerant from the condenser coil and expanding same;

an evaporator coil in the cabinet and receiving refrigerant from the expansion device and evaporating same, and delivering the refrigerant to the compressor;

the refrigerant being circulated from the compressor to the condenser coil to the expansion device to the evaporator coil and back to the compressor in a refrigeration cycle;

the cabinet having an airflow path therethrough comprising:

a first segment passing ambient air to the evaporator coil, a second segment passing air from the evaporator coil to the condenser coil, a third segment discharging air from the condenser coil, a fourth segment passing ambient air to the condenser coil; and a bypass door selectively positionable to block airflow along the fourth segment and alternately to allow airflow along the fourth segment; and an actuator structured to move the bypass door between an open position to allow the airflow along the fourth segment and a closed position to block the air flow along the fourth segment.

2. The dehumidifier according to claim 1, wherein the actuator comprises an electric motor operatively coupled to the bypass door.

3. The dehumidifier according to claim 1, wherein the actuator comprises a bimetal disc configured to cause the bypass door to move from one of the open and closed positions when the ambient airflow temperature rises above a predetermined level and to move from the other of the open and closed positions when the ambient airflow temperature drops below a predetermined level.

4. The dehumidifier according to claim 1, wherein the actuator comprises a bimetal disc configured to cause the bypass door to move from one of the open and closed positions when at least one of a refrigerant suction, discharge, or liquid temperature rises above a predetermined level and to move from the other of the open and closed positions when the refrigerant suction, discharge, or liquid temperature drops below a predetermined level.

5. The dehumidifier according to claim 1, further comprising a controller configured to selectively actuate the actuator and thereby selectively move the bypass door between the open and closed positions.

6. The dehumidifier according to claim 5, further comprising a sensor configured to sense an operational parameter of the dehumidifier and to communicate the parameter to the controller, wherein the controller is further configured to actuate the actuator based upon the sensed parameter.

7. The dehumidifier according to claim 6, wherein the controller is configured to actuate the actuator when the sensed parameter is outside of a predetermined range.

8. The dehumidifier according to claim 7, wherein the controller comprises a memory stored with the predetermined range and an operating platform that is configured to compare the sensed parameter to the predetermined range and to then actuate the actuator when the parameter is outside of the predetermined range.

9. The dehumidifier according to claim 8, wherein the controller is configured to identify an optimal bypass door position based upon the comparison and then actuate the actuator to move the bypass door to the optimal bypass door position.

10. The dehumidifier according to claim 6, wherein the sensed parameter comprises the temperature of the ambient air.

11. The dehumidifier according to claim 6, wherein the sensed parameter comprises the relative humidity of the ambient air.

12. The dehumidifier according to claim 6, wherein the sensed parameter comprises refrigerant temperature.

13. The dehumidifier according to claim 6, wherein the sensed parameter comprises refrigerant suction pressure.

14. The dehumidifier according to claim 6, wherein the sensed parameter comprises refrigerant discharge pressure.

15. In a dehumidifier comprising a cabinet; a compressor in the cabinet for delivering hot compressed refrigerant; a condenser coil in the cabinet and receiving refrigerant from the compressor and condensing same; an expansion device in the cabinet and receiving refrigerant from the condenser coil and expanding same; an evaporator coil in the cabinet and receiving refrigerant from the expansion device and evaporating same, and delivering the refrigerant to the compressor, the refrigerant being circulated from the compressor to the condenser coil to the expansion device to the evaporator coil and back to the compressor in a refrigeration cycle; the cabinet having an airflow path therethrough comprising a first segment passing ambient air to the evaporator coil, a second segment passing air from the evaporator coil to the condenser coil, a third segment discharging air from the condenser coil, a fourth segment passing ambient air to the condenser coil; a method comprising the step of:

selectively blocking and allowing airflow along the fourth segment to optimize operation of the dehumidifier.

16. The method according to claim 15, further comprising the step of sensing an operational parameter of the dehumidifier and selectively blocking and allowing the airflow along the fourth segment based upon the sensed parameter.

17. The method according to claim 16, further comprising the step of operating a bypass door to selectively block and allow the airflow along the fourth segment.

18. The method according to claim 17, further comprising the step of operating a controller to actuate the bypass door.

19. The method according to claim 18, further comprising the step of operating the controller to compare the sensed parameter to a predetermined range and then operating the bypass door to block the airflow along the fourth segment if the parameter of ambient air is outside of the predetermined range.

20. A dehumidification system comprising:

a dehumidifier comprising a cabinet;

a compressor in the cabinet for delivering hot compressed refrigerant;

a condenser coil in the cabinet and receiving refrigerant from the compressor and condensing same;

an expansion device in the cabinet and receiving refrigerant from the condenser coil and expanding same;

an evaporator coil in the cabinet and receiving refrigerant from the expansion device and evaporating same, and delivering the refrigerant to the compressor;

the refrigerant being circulated from the compressor to the condenser coil to the expansion device to the evaporator coil and back to the compressor in a refrigeration cycle;

the cabinet having an airflow path therethrough comprising:

a first segment passing ambient air to the evaporator coil, a second segment passing air from the evaporator coil to the condenser coil, a third segment discharging air from the condenser coil, a fourth segment passing ambient air to the condenser coil; and a bypass door selectively positionable to block airflow along the fourth segment and alternately to allow airflow along the fourth segment;

an actuator; and a controller configured to selectively actuate the actuator and thereby selectively move the bypass door between the open and closed positions.

21. The system according to claim 20, further comprising a sensor configured to sense an operational parameter of the dehumidifier and to communicate the parameter to the controller, wherein the controller is further configured to actuate the actuator based upon the sensed parameter.

22. The system according to claim 21, wherein the controller is configured to actuate the actuator when the sensed parameter is outside of a predetermined range.

23. The system according to claim 22, wherein the controller comprises a memory stored with the predetermined range and an operating platform that is configured to compare the sensed parameter to the predetermined range and to then actuate the actuator when the parameter is outside of the predetermined range.

24. The system according to claim 23, wherein the controller is configured to identify an optimal door position based upon the comparison and then actuate the actuator to move the door to the optimal door position.

* * * * *